US007628689B2

(12) United States Patent
Snow

(10) Patent No.: US 7,628,689 B2
(45) **Date of Patent: *Dec. 8, 2009**

(54) POKER GAME WITH BLIND BET AND PLAYER SELECTABLE PLAY WAGER

(75) Inventor: Roger M. Snow, Las Vegas, NV (US)

(73) Assignee: Shuffle Master, Inc., Las Vegas, NV (US)

( * ) Notice: Subject to any disclaimer, the term of this patent is extended or adjusted under 35 U.S.C. 154(b) by 305 days.

This patent is subject to a terminal disclaimer.

(21) Appl. No.: 11/497,999

(22) Filed: Aug. 2, 2006

(65) Prior Publication Data

US 2006/0270477 A1 Nov. 30, 2006

Related U.S. Application Data

(63) Continuation of application No. 11/409,711, filed on Apr. 24, 2006, and a continuation-in-part of application No. 10/864,051, filed on Jun. 8, 2004, now Pat. No. 7,387,300, which is a continuation-in-part of application No. 10/152,325, filed on May 20, 2002, now abandoned.

(51) Int. Cl.
*A63F 1/00* (2006.01)

(52) U.S. Cl. ..... 463/13; 273/292

(58) Field of Classification Search ..... 273/292, 273/274, 309; 463/13

See application file for complete search history.

(56) References Cited

U.S. PATENT DOCUMENTS 4,743,022 A 5/1988 Wood 4,836,553 A 6/1989 Suttle et al.

(Continued)

FOREIGN PATENT DOCUMENTS

GB 667345 2/1952

OTHER PUBLICATIONS

Copyright filing with the Bureau voor de Intellectuele Eigendom, Aruba, 13 pgs (Jan. 13, 1998).

(Continued)

*Primary Examiner*—Benjamin H Layno
(74) *Attorney, Agent, or Firm*—Mark A. Litman & Associates, P.A.

(57) ABSTRACT

A system and method for conducting wagering games utilizing one or more decks of standard playing cards preferably including the steps of: receiving an ante wager from a player; receiving a blind wager from the player; dealing a plurality of cards to the player to form a player's hand; dealing a plurality of cards to a dealer to form a dealer's hand; receiving a play wager from the player or the player folding; comparing the poker rank of the player's hand with the poker rank of dealer's hand to resolve the ante and play wagers, wherein the player wins the ante and play wagers if the player's hand outranks the dealer's hand; and comparing the player's hand with a predetermined winning criteria to resolve the blind wager, wherein the player wins the blind wager if the player's hand satisfies the predetermined winning criteria and outranks the dealer's hand, the blind wager pushes if the player's hand outranks the dealer's hand but does not satisfy the predetermined winning criteria, and the blind wager loses when the dealer hand outranks the player hand and the player does not satisfy the predetermined winning criteria.

21 Claims, 10 Drawing Sheets

U.S. PATENT DOCUMENTS

| | | | | |
|---|---|---|---|---|
| 4,861,041 | A | | 8/1989 | Jones et al. |
| 5,022,653 | A | | 6/1991 | Suttle et al. |
| 5,174,579 | A | | 12/1992 | Griffiths |
| 5,255,915 | A | | 10/1993 | Miller |
| 5,257,784 | A | | 11/1993 | Boylan et al. |
| 5,257,810 | A | | 11/1993 | Schorr et al. |
| 5,265,877 | A | | 11/1993 | Boylan et al. |
| 5,275,415 | A | | 1/1994 | Wisted |
| 5,288,081 | A | | 2/1994 | Breeding |
| 5,294,128 | A | | 3/1994 | Marquez |
| 5,366,228 | A | | 11/1994 | Kangsanaraks |
| 5,377,973 | A | | 1/1995 | Jones et al. |
| 5,377,994 | A | | 1/1995 | Jones |
| 5,397,128 | A | | 3/1995 | Hesse et al. |
| 5,489,101 | A | | 2/1996 | Moody |
| 5,494,295 | A | | 2/1996 | Potter et al. |
| 5,505,449 | A | | 4/1996 | Eberhardt et al. |
| 5,584,486 | A | | 12/1996 | Franklin |
| 5,685,774 | A | * | 11/1997 | Webb ..... 463/13 |
| 5,697,614 | A | | 12/1997 | Potter et al. |
| 5,718,430 | A | | 2/1998 | Aramapakul et al. |
| 5,851,011 | A | | 12/1998 | Lott |
| 5,897,436 | A | | 4/1999 | Singer et al. |
| 6,012,719 | A | | 1/2000 | Webb |
| 6,113,103 | A | | 9/2000 | Mostashari |
| 6,170,827 | B1 | | 1/2001 | Lombardo et al. |
| 6,206,373 | B1 | | 3/2001 | Garrod |
| 6,273,424 | B1 | | 8/2001 | Breeding |
| 6,607,443 | B1 | | 8/2003 | Miyamoto et al. |
| 2002/0175468 | A1 | | 11/2002 | Kenny et al. |

OTHER PUBLICATIONS

"Show Five Cards", Scarne's Encyclopedia of Games, John Scarne, Harper & Row Publishers, pp. 28-29, 1973.

Published Rule Sheet for Casino Poker from Vegas World, 1 page (1982).

Three Card Poker Disclosure by Derek J. Webb.

* cited by examiner

POKER GAME WITH BLIND BET AND PLAYER SELECTABLE PLAY WAGER

CROSS REFERENCE TO RELATED APPLICATIONS

This Application is a Continuation of U.S. patent application Ser. No. 11/409,711, filed Apr. 24, 2006 titled "POKER GAME WITH BLIND BET AND PLAYER SELECTABLE PLAY WAGER," which is a Continuation-in-Part of U.S. patent application Ser. No. 10/152,325, filed May 20, 2002 (now abandoned), as well as a Continuation-in-Part of U.S. patent application Ser. No. 10/864,051, filed Jun. 8, 2004, now U.S. Pat. No. 7,387,300.

BACKGROUND OF THE INVENTION

This Application is also related to pending application Ser. No. 10/764,995, filed Jan. 26, 2004, pending application Ser. No. 10/764,994, filed Jan. 26, 2004; pending application Ser. No. 10/974,506, filed Oct. 27, 2004; and pending application Ser. No. 11/156,352, filed Jun. 7, 2005. The entire content of each of the above-identified pending application in both the claim of priority and statement of related applications is incorporated by reference.

1. Field of the Invention

The present invention relates to games, and more particularly to card-type games that are suitable for use in gaming establishments, and more particularly to poker-type card games that are suitable for use in gaming establishments.

2. Background of the Art

Casinos and leisure establishments continually require new games to offer their clientele. Such games are generally required to enable each player to play against a banker (who usually also acts as dealer) provided by the casino, rather than against other players. Alternatively, in a "card room" game, each player may have the option to act as banker, while the establishment runs the game on behalf of the banker and takes fees from the players.

Players typically enjoy games which can be played rapidly and which offer players a plurality of choices. A plurality of choices heightens player interest in games. It would therefore be desirable to provide card games comprising a plurality of new wagering options.

U.S. Pat. Nos. 5,685,774, 6,056,641, 6,237,916 and 6,345,823 to Webb (all assigned to Shuffle Master, Inc.) and U.S. Pat. No. 6,698,759 disclose methods for playing the game of Three Card Poker®, as well as some variants of the Three Card Poker® game. In one popular version of the game, three cards are dealt to each player and three cards are dealt to the dealer, all face down. Initially one or two optional wagers may be made by the player. One such wager is for the "Pair Plus" bonus bet, a bet on achieving a winning combination included in a payout table. Another wager is the game Ante on which the player competes against the dealer. The Pair Plus bet in one disclosed example is a wager that the three card hand will have a rank of at least one pair or more. The hand is paid off in multiples of the bet depending upon the rank of the hand, with up to 40:1 paid out for three-of-a-kind. If the player wants to compete against the dealer's hand he places an Ante wager. After viewing the rank of the player's hand, an additional Play wager equal to the ante must be placed by the player. The dealer's hand is then exposed. If the dealer does not have a hand of at least a certain qualifying rank (e.g., at least Queen high), the dealer's hand is not in play. If the player has not made the additional wager, the ante is collected by the dealer at some point in the play of the game. If the player has made the additional wager, the ante is paid off to the player if the dealer's hand has not qualified or if the dealer's hand is not as high a rank as the player's hand. If the dealer's hand has qualified, and the dealer's hand is higher than the player's hand, then the ante and the additional wager are collected by the house. If the dealer's hand qualifies (e.g., at least Queen high) and is lower than the player's hand rank, both the ante and additional wager are paid off, with multiples payable to the ante wager for certain high ranking hands (e.g., straights, flushes, straight flushes, three-of-a-kind, etc.). The hierarchy of the various poker hands is different than in typical five card poker games.

LET IT RIDE BONUS® Poker, as disclosed in Breeding, U.S. Pat. No. 6,334,614, entitled MULTI-TIERED WAGERING METHOD AND GAME, the content of which is hereby incorporated by reference, and the more basic play of LET IT RIDE® casino table poker game as described in U.S. Pat. Nos. 5,437,462 and 5,288,081 disclose a card game in which the player plays a 5 card poker game. In the base game, a player makes a three-part wager on the occurrence of one of a number of predetermined winning hands. Each player is dealt three cards, and the dealer is also dealt three cards. One dealer card is discarded, and the other two cards are placed face down on the table and serve as common cards. The player may withdraw a first portion of his bet after he has examined his partial three-card hand. Two community cards are used by each player to form a five-card hand. After the dealer turns the first community card face up, the player is given the opportunity to withdraw a second portion of his bet. The third bet must remain at risk.

Standard 5-card poker rankings are used to determine the hierarchy of payouts. The hands that pay (highest to lowest) in a typical LET IT RIDE® basic game are: royal flush, straight flush, four of a kind, full house, flush, straight, three of a kind, two pair, and a pair. Each winning hand pays odds, and all winning outcomes and corresponding payout odds are listed in a pay table. Optionally, the player can place a side bet on the occurrence of certain high ranking hands within the predetermined winning outcomes in the base game. Both the player cards and the dealer's common cards are used to define the player's hand and corresponding hand ranking in the side bet game. Players are required to make a multiple part bet, and can optionally withdraw part of the bet upon viewing some of the cards.

There are many wagering games used for gambling. Such games should be sufficiently exciting to arouse players' interest and uncomplicated so they can be understood easily by a large number of players. Ideally, the games should include more than one wagering opportunity during the course of the game, yet be able to be played rapidly to a wager resolving outcome. Exciting play, the opportunity to make more than one wager and rapid wager resolution enhance players' interest and enjoyment because the frequency of betting opportunities and bet resolutions is increased.

Wagering games, particularly those intended primarily for play in casinos, should provide players with a sense of participation and control, the opportunity to make decisions, and reasonable odds of winning, even though the odds favor the casino, house, dealer or banker. The game must also meet the requirements of regulatory agencies.

Wagering games, including wagering games for casino play, with multiple wagering opportunities are known. U.S. Pat. Nos. 4,861,041 and 5,087,405 (both to Jones et al.) disclose methods and apparatus for progressive jackpot gaming, respectively. The former patent discloses that a player may make an additional wager at the beginning of a hand, the outcome of the additional wager being determined by a predetermined arrangement of cards in the player's hand. U.S. Pat. No. 4,836,553 (to Suttle and Jones) discloses a modified version of a five card stud poker game.

U.S. Pat. No. 6,170,827 describes another poker-type casino table card game. This game may be played at a table with as many as seven players competing against a dealer. The play of the game is fairly complex, with each player having both multiple hands and utilization of a dealer's card. One method of play is to provide each player with three cards, and the dealer is provided with four cards. The dealer's play of cards is predetermined, while the players may select their desired holding. Player's hands are competing directly against the dealer's hand in each of the hands made by the player and the dealer.

Live table games have various limitations and disadvantages that have long plagued the casino industry, some of which are of general concern and apply to all or most live table games, while others relate to specific games and the use of playing cards and/or live dealers therein. Some of the principal concerns and problems are discussed below.

For example, the use of playing cards at live table games typically involves several operational requirements that are time-consuming and distract from the play or the entertainment value of the game. These operations include collecting, shuffling, dealing and reading of the cards. In many card games there is also a step of cutting the deck after it has been shuffled. In the collecting operation, a live dealer typically collects the cards just played at the end of a hand of play. This is done in preparation for playing the next hand of cards. When electronic monitoring systems are used, the cards must sometimes be collected in the specific order in which they had appeared in the play of the game and must also be collected in a specific orientation, such as all cards being in a facedown or face-up condition. The cards also are typically straightened into a stack with the long sides and short sides aligned.

These manipulations of the cards involve a break in the action of the table game and consume a significant amount of time, thus reducing the rate at which the game is played. Since the casino averages a certain percentage of wins based on the amount of hands played, any operations that reduce the amount of games that can be played over time also reduces the casino's potential earnings. As should be readily apparent, the casino industry has a keen interest in implementing devices and methods that can increase the rate at which the games are played.

The use of high quality shuffling machines, such as those produced by Shuffle Master, Inc. (Las Vegas, Nev.) and disclosed in U.S. Pat. Nos. 6,655,684; 6,651,982; 6,588,751; 6,588,750; 6,568,678; 6,325,373; 6,254,096; 6,149,154; 6,139,014; 6,068,258; and 5,695,189, among others, has greatly improved card handling operations. By automating the most time-consuming portion of the card handling operations, casinos that use these patented shuffling machines can significantly increase their revenue earning capability. However, there is still room for advancement, despite the important benefits offered by Shuffle Master's shuffling machines. In particular, there still exists the need for human operators and dealers, as well as playing cards.

The expense associated with the purchasing, handling and disposing of paper and plastic playing cards can be significant. Casinos pay relatively favorable prices for card decks, but the decks roughly cost about $1 per deck at this time. There are also significant costs associated with handling and storing the new and worn playing cards. Sizable rooms located in the casino complexes are needed just to store the cards as they are coming and going. The cost of maintaining such facilities further exacerbates the expenses associated with paper and plastic playing cards. Furthermore, each casino uses decks for a very limited period of time, typically only one shift, and almost always less than one day. After this relatively brief life in the limelight, the decks are disposed of in a suitable manner. In some cases they are marked to show that they have been decommissioned from a casino and are sold as souvenirs. In other cases the playing cards are simply destroyed or recycled to eliminate the risk the cards will be used by card cheats. In any case, the cost of playing cards for a casino can easily run in the hundreds of thousands of dollars per year.

One of the other significant expenditures for the casinos relates to personnel costs. Attempts have been made to reduce time requirements for not only the dealers, relief dealers, but also for the supervisors, managers, security and the other staff that are directly or indirectly involved in the operation or maintenance of games. However, as long as there are live table games played in the casino, there is no avoiding the need to assign a suitable amount of casino employees to attend thereto.

The human factor involved in live table games also requires that casinos devote a significant amount of resources to maintaining the security and integrity of the games. Attempts to cheat may be made by players, dealers, or more significantly by dealers and players in collusion. The amount of cheating in card games is significant to the casino industry and constitutes a major security problem that has large associated losses. Accordingly, the costs of efforts to deter or prevent cheating are very large. Many of the attempts to cheat in the play of live table card games involve some aspect of dealer or player manipulation of cards during collection, shuffling, cutting or dealing cards.

Another notable problem associated with live table games is the intimidation which many novice or less experienced players feel when playing such games. Surveys have indicated that many people that are new or less experienced at gambling are inclined to play slot machines and virtual card games because they feel uncomfortable at making what they perceive as quick decisions in the presence of the dealer and other possibly more experienced players. This intimidation factor reduces participation in table games.

For reasons such as those cited above, casinos have a compelling interest in providing a poker-style game with simplified betting structure and dealing procedures that provides a player with sufficient betting options to maintain player interest, and follows the rules of poker, as poker rules are well known throughout the world. Casinos also have an interest in reducing personnel costs and the potential for fraud. Thus, casinos have a need for both interesting live table games and systems for implementing such games in a manner that prohibits cheating, reduces personnel costs, and appeals to players of all experience levels at least as much as the live table game itself. Accordingly, the present invention is directed to a game and gaming systems that meets these needs.

SUMMARY OF THE INVENTION

The present invention meets the aforementioned needs, among other things, by providing a new and interesting wagering game and method for conducting the same in a casino environment using one or more decks of standard playing cards. The present invention also meets the aforementioned needs by providing an interactive system which is both configured for simulating a wagering game, such as those games which up to now have been traditionally played as a live table game, and adapted to facilitate the typical features of game play, including receiving credit wagers from one or more live players, providing players with virtual game hands, and allowing players the opportunity to win on their respective wagers, without involving physical playing cards, chips or live casino personnel.

In one embodiment, a method according to the present invention includes the steps of receiving an ante wager from a player; receiving a blind wager from the player; dealing at least three cards to the player to form a player's three card hand; dealing at least three cards to a dealer to form a dealer's three card hand; receiving a play wager from the player, wherein the play wager may be a multiple of the ante wager and the selection of the multiple is made by the player; comparing the three card poker rank of the player's hand with the three card poker rank of dealer's hand to resolve the ante and play wagers, wherein the player wins the ante and play wagers if the player's hand outranks the dealer's hand; and comparing the three card poker rank of the player's hand with a predetermined winning criteria to resolve the blind wager.

The player wins the blind wager if the player's hand satisfies the predetermined winning criteria and outranks the three card poker rank of the dealer's hand. The blind wager pushes if the player's hand outranks the three card poker rank of the dealer's hand but does not satisfy the predetermined winning criteria. The blind wager loses when the player's hand is of a lower rank than the dealer's hand and does not meet the predetermined winning criteria. The aforementioned embodiment may also include a dealer qualification aspect as discussed below.

The predetermined winning criteria is preferably based on conventional poker-type hand ranks, such as straight, flush and or straight flush, but may also be based on other events, such as for example, receiving a hand consisting of cards of different suits, a grouping of particular cards chosen randomly or otherwise prior to the deal, a wild or otherwise designated winning card or a certain hand value using a blackjack or other numerical card valuing system.

In one alternative of the aforementioned embodiment, receiving an ante wager from a player is required to permit the player to participate in at least a first portion of a round of the game. In a preferred alternative of the aforementioned embodiment, receiving the ante wager and blind wager are required to participate. In another preferred alternative embodiment, receiving the play wager from the player is required to permit the player to participate in a final portion of the round. In yet another preferred alternative embodiment, the ante wager and blind wager are forfeited if a play wager is not received from the player.

The ante and blind wagers may be placed in different amounts, but are preferably equal. The play wager may be placed in any amount, but is preferably placed as a multiple of the ante wager. Alternatively, the play wager may be dependent on the three card poker rank of the player's hand. For example, if the player's hand satisfies a predetermined qualification or ranking, the play bet can be a multiple of the ante selected by the player. Preferably, the multiple is selected from a group of possible multiples, such as from 1 to 3 times the ante wager.

According to another alternative embodiment, the aforementioned method includes the steps of receiving a pair plus wager from the player; and providing a pair plus payout to the player if the rank of the player's hand equals or outranks one Pair. The pair plus wager is resolved either prior to or after receiving a play wager from the player and the pair plus payout is preferably provided to the player regardless of whether the play wager is received from that player. The pair plus can also have a payout schedule which increases depending on the three card poker rank of the player's hand. Preferably, the pair plus payout amount is expressed and paid as multiples of the pair plus wager.

According to yet another embodiment, the aforementioned method includes dealer qualification steps. The dealer qualification steps can include revealing the dealer's hand to the player upon the play wager being received from the player; and comparing the three card poker rank of the dealer's hand with a predetermined qualifying rank, wherein the ante wager is returned to the player if the predetermined qualifying rank outranks the dealer's hand. Preferably, the player wins the ante and play wagers if both the predetermined qualifying rank and player's hand outrank the dealer's hand.

The present invention is also directed to a method of conducting a wagering game based on poker utilizing one or more decks of standard playing cards which includes the following the steps: receiving an ante wager from a player to participate in at least a portion of one round of the game; receiving a blind wager from the player; dealing a plurality of cards to the player to form a player's hand, wherein the player is permitted to view the player's hand; dealing a plurality of cards to a dealer to form a dealer's hand, wherein the dealer's hand is not displayed to the player; receiving a play wager from the player, wherein the player forfeits the ante and blind wagers and does not continue in the round if the play wager is not received; revealing the dealer's hand to the player; comparing the three card poker rank of the player's hand with the three card poker rank of dealer's hand to resolve the ante and play wagers, wherein the player wins the ante and play wagers if the player's hand outranks the dealer's hand; and comparing the three card poker rank of the player's hand with a plurality of predetermined winning hand ranks to resolve the blind wager, wherein the player wins the blind wager if the three card poker rank of the player's hand is equal to one of the plurality of predetermined winning hand ranks and outranks the dealer's hand, and the blind wager pushes if the player's hand outranks the dealer's hand but does not satisfy the predetermined winning rank.

In an alternative embodiment, the predetermined winning hand ranks are royal flush, straight flush, three of a kind, straight and flush. This embodiment may further include the step of awarding a payout to a player winning the blind wager, wherein the payout is a preset multiple of the blind wager.

This embodiment may also include a dealer qualification element, and thus may include the step of comparing the three card poker rank of the dealer's hand with a predetermined qualifying rank, wherein the ante wager is returned to the player if the predetermined qualifying rank outranks the three card poker rank of the dealer's hand and the player wins the play wager if both the predetermined qualifying rank and the three card poker rank of the player's hand outrank the dealer's hand. Preferably, the predetermined qualifying rank is Queen high, but may also be another hand rank, such as Ace high. The outcome of winning the play wager may be winning even money on the original play wager bet.

As in the previous embodiments, the play wager may be a multiple of the ante wager, where the multiple is selected by the player. In one form of the invention, the multiple allowed for player selection depends on the rank of the player's hand. For example, if a player's hand has a three card poker rank of less than a pair, the play wager may only be equal to the ante wager whereas if the player's hand has a ranking better than a pair, the play wager may be one, two or even three times the ante. In one form of the invention, the player's hand must have a pair of 10's or better to be entitled to raise the play bet above a multiple of one.

It should be readily apparent that the ante, blind and/or pair plus wagers may be either mandatory or optional in accordance with the present invention. However, in one preferred embodiment of the present invention, the ante and blind wagers are mandatory while the pair plus wager is optional.

The present invention is also directed to a multi-player platform that provides multiple player positions for live players to engage in an interactive electronic wagering game with a virtual dealer and virtual cards. The platform comprises at least two player positions that enable players to place wagers on the same game, a display system for showing a virtual dealer, a display system for showing the virtual cards used in play of the game, and a database that contains the rules of the wagering game, the processor enabling play for each player according to the rules in the database.

In one embodiment, the multi-player platform is configured and adapted to provide a game comprising the steps of: receiving an ante wager from a player; receiving a blind wager from the player; dealing a plurality of cards to the player to form a player's hand; dealing a plurality of cards to a dealer to form a dealer's hand; optionally receiving a play wager from the player; comparing the three card poker rank of the player's hand with the rank of dealer's hand to resolve the ante and play wagers, wherein the player wins the ante and play wagers if the player's hand outranks the dealer's hand; and comparing the player's hand with a predetermined winning criteria to resolve the blind wager, wherein the player wins the blind wager if the three card poker rank of the player's hand satisfies the predetermined winning criteria and outranks the dealer's hand, and the blind wager pushes if the player's hand outranks the dealer's hand but does not satisfy the predetermined winning criteria. The blind wager loses if the dealer hand outranks the player hand and the player hand rank is below the predetermined winning criteria. Preferably, each of the players and the dealer receive only three cards.

According to an embodiment of the present invention, the aforementioned game and platform are configured and adapted so that the ante wager and blind wager are forfeited if the play wager is not received from the player.

According to an embodiment of the present invention, the aforementioned game and platform are configured and adapted so that the ante wager and the blind wager are required to permit the player to participate in at least a first portion of a round of the game.

According to an embodiment of the present invention, the aforementioned game and platform are configured and adapted so that the ante and blind wagers must be wagers of an equal amount.

According to an embodiment of the present invention, the aforementioned game and platform are configured and adapted so that the play wager is a multiple of the ante wager selected by the player when the three card poker rank of the player's hand outranks a qualifying hand rank. The qualifying hand rank can be one pair or greater. Preferably, the player is allowed to select from a range of multiples, such as 1, 2 or 3 times the ante wager.

According to another embodiment of the present invention, the aforementioned game and platform are configured and adapted to include the steps of: receiving a pair plus wager from the player; and providing a pair plus payout to the player if the player's hand rank equals or outranks one Pair. The aforementioned game and platform are preferably configured and adapted so that the pair plus wager is resolved prior to receiving a play wager from the player, and regardless of whether the play wager is placed by the player. In one embodiment, the aforementioned game and platform are configured and adapted so that the pair plus payout increases depending on the three card poker rank of the player's hand being greater than one Pair.

According to an embodiment of the present invention, the aforementioned game and platform are configured and adapted to include the steps of: revealing the dealer's hand to the player upon the play wager being received from the player; and comparing the three card poker rank of the dealer's hand with a predetermined qualifying rank, wherein the ante wager is returned to the player if the predetermined qualifying rank outranks the dealer's hand and the player wins the play wager if both the predetermined qualifying rank and the three card poker rank of the player's hand outrank the three card poker rank of the dealer's hand.

The present invention is also directed to a system for playing a wagering game comprising a database, a processor and a user interface. The database preferably is configured and adapted for storing game data relating to rules of a poker-type game, and a predetermined blind wager winning criteria and a pay table relating thereto. The processor is preferably configured and adapted for receiving an ante wager from a player; receiving a blind wager from the player; dealing a plurality of cards to the player to form a player's hand; dealing a plurality of cards to a dealer to form a dealer's hand; receiving a play wager from the player; comparing the three card poker rank of the player's hand with the three card poker rank of dealer's hand to resolve the ante and play wagers, wherein the player wins the ante and play wagers if the player's hand outranks the dealer's hand; and comparing the player's hand with the predetermined blind wager winning criteria to resolve the blind wager, wherein the player wins the blind wager if the player's hand satisfies the predetermined blind wager winning criteria and outranks the dealer's hand, the blind wager pushes if the player's hand outranks the dealer's hand but does not satisfy the predetermined winning criteria, and the blind wager is lost if the dealer hand outranks the player hand and the player hand does not meet the predetermined winning criteria. The user interface is preferably configured and adapted for facilitating player wagers and communicating game activity. The user interface may also be configured and adapted to distribute payouts to winning players, which may be in the form of credit to a secure account.

According to one embodiment of the present invention, the user interface is a portable, semi-portable or handheld device configured to provide the player with access to a game through wireless communication with other system components.

According to another embodiment of the present invention, the user interface is configured to operate over the world wide web to provide the player with access to the game using the world wide web.

The present invention is also directed to a machine readable media for facilitating a method of playing a wagering game, comprising one or more data segments and one or more code segments. The one or more data segments are preferably configured and adapted for storing game data relating to rules of a poker-type game, and storing a predetermined blind wager winning criteria and a pay table relating thereto. The one or more code segments are preferably configured and adapted for receiving an ante wager from a player; receiving a blind wager from the player; dealing a plurality of cards to the player to form a player's hand; dealing a plurality of cards to a dealer to form a dealer's hand; receiving a play wager from the player; comparing the three card poker rank of the player's hand with the three card poker rank of dealer's hand to resolve the ante and play wagers, wherein the player wins the ante and play wagers if the player's hand outranks the dealer's hand; and comparing the player's hand with the predetermined blind wager winning criteria to resolve the blind wager, wherein the player wins the blind wager if the player's hand satisfies the predetermined blind wager winning criteria and outranks the dealer's hand, the blind wager pushes when the player's hand outranks the dealer's hand but does not satisfy the predetermined winning criteria, and the blind wager loses when the player hand is a lower rank than the dealer hand and the player hand does not meet the predetermined winning criteria.

Alternatively, the hand rankings may be ranked according to two, four or five card poker hand ranks, and thus, the amount of cards dealt to the players and dealer may be increased or decreased accordingly. In addition, the dealer may be dealt hands with one or more cards greater than the players, or vice versa. The player and/or dealer may be dealt additional cards and cards may also be discarded to form a final hand. Cards may also be dealt in multiple phases, for example in a group of two, then a group of 1, to form a final three card hand, or in a group of three, then a group of two to form a final five card hand. It should also be understood that any hand rankings discussed herein, whether it be for the dealer's hand or player's hand, are always intended to be the highest ranking possible from cards available in the respective hand. For example, the three card poker rank of a hand consisting of five cards would consist of the three cards out of the five that form the highest ranking three card poker hand according to the hierarchy of hand ranks in three card poker.

These and other aspects of the system and method of the present invention will become more readily apparent to those having ordinary skill in the art from the following detailed description of the invention taken in conjunction with the drawings.

BRIEF DESCRIPTION OF THE DRAWINGS

So that those having ordinary skill in the art to which the present invention pertains will more readily understand how to make and use the method and system of the present disclosure, preferred and exemplary embodiments thereof will be described in detail herein below with reference to the drawings, wherein.

DETAILED DESCRIPTION OF THE INVENTION

The following description is provided to illustrate various embodiments of the invention, but the description is not intended to limit the scope of the invention.

For the purposes of this disclosure, "game elements" or "gaming elements" means information used by a player or dealer to participate in the game such as the face value of cards, dice, the face value of a die or dice, slot symbols, angular positions on a wheel or reel game, cards (e.g., from a standard or non-standard playing deck), tiles or the like. A preferred medium of play is with a single, typical (standard) fifty-two card poker deck (with or without jokers, or with cards removed as with Spanish Twenty-One™ where tens are removed from the deck) and a specific preferred game broadly involves the generally well recognized and accepted set of rules, procedures and wager-resolving outcomes of poker.

The game method comprises each player placing an initial wager or wagers to participate in the game. The dealer then distributes cards to initiate play. In alternate forms of the invention, dice or other gaming implements such as wheels, reels, special cards etc. can be used in lieu of or in addition to standard playing cards.

Four Card Example

Figure 1A:
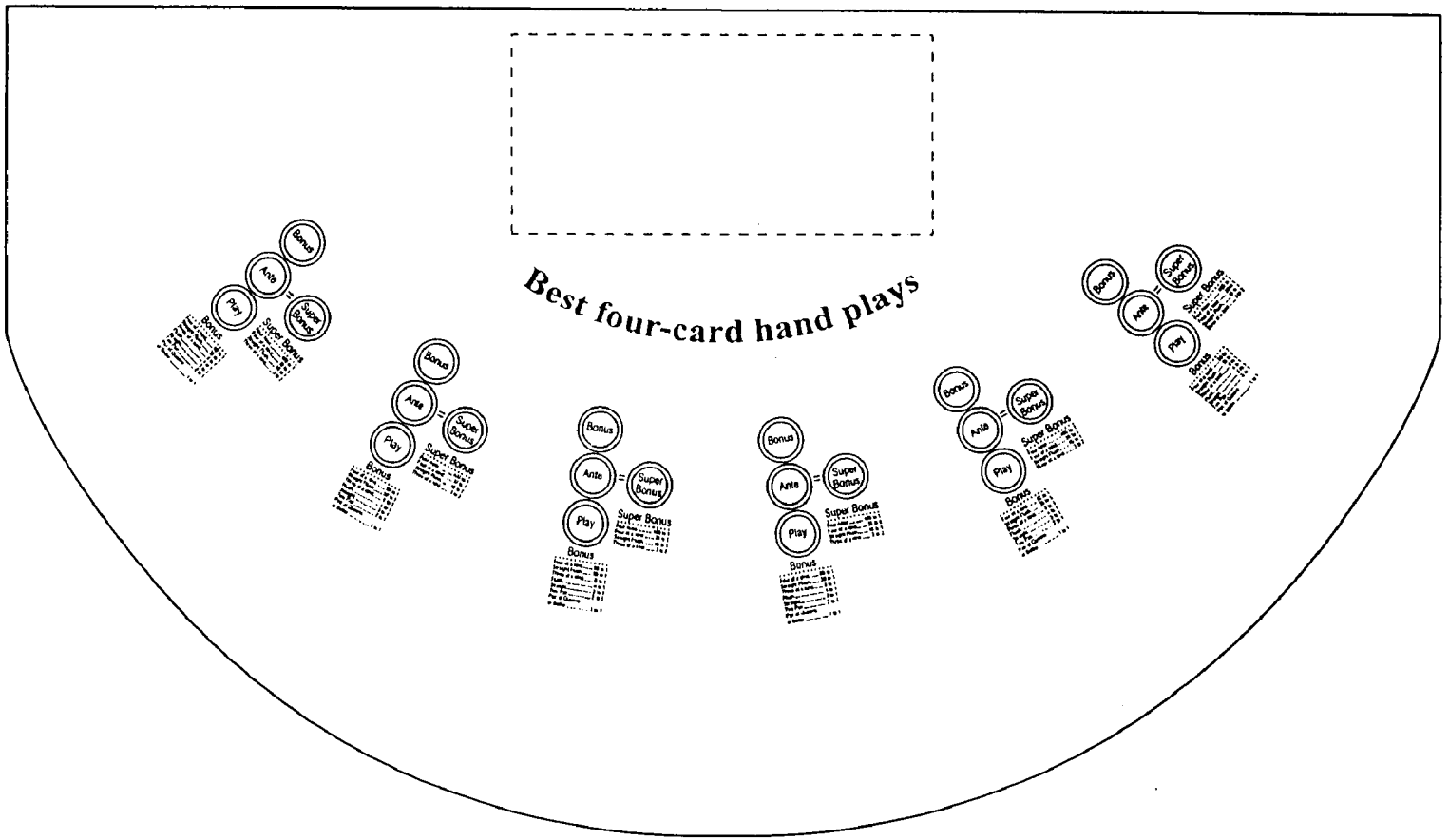
FIG. 1A shows a playing surface for a four card version of an embodiment of the game of the present invention.

A casino table card game is played on a table by at least one player and a dealer. The dealer usually represents the house or the casino in the play of the game. As shown in FIG. 1, wagering areas 10 are provided for each player, and card receiving areas 12 are available for each of the players and the dealer. The wagering area may include three distinct wagering zones for each player comprising a Bonus wager area 14 (e.g., the Aces-Up wager), an Ante area 16, and a Bet area 18. To initiate play of the game, at least one (and usually only one) deck of standard or variant playing cards is provided. In other forms of the game, multiple intermixed decks of cards, decks with wild cards or special decks (i.e. decks with certain cards removed) are used. Each player who wishes to enter the play of the game makes at least one wager selected from the Bonus Bet (or Aces-Up bet) and the Ante. One or both of these wagers may be made. The player may also play the hand blind (also referred to as the "House Way") by placing both an Ante and an additional Game Bet (referred to in FIG. 1 as the "Play Bet"). After placement of the at least one wager, each player who has made an at least one wager is provided with a number of cards, preferably five, from which to select a best four-card poker hand. The cards may be dealt as a complete set of five cards or in portions of one or more cards. At about the same time, the dealer is dealt a number of cards exceeding four. In one example of the invention, six cards are dealt. One or more additional cards can be dealt to the player, the dealer or both.

Although in one example of the invention the dealer receives one more card than each player, the number of cards dealt can be equal. What is important is that enough cards are dealt so that at least one discard can be made.

In a preferred form of the invention, a four card poker hand is played. The player reviews the five cards received at that player position and determines what best four-card poker hand can be made from the five cards. If the player believes that the cards cannot form a four-card poker rank of sufficiently high rank to warrant competition against the dealer's hand (even without that hand or any portion of that hand having been displayed), the player may fold the hand, refusing to place an additional wager. At this time or usually a later time, the Ante would be collected by the dealer. In one example of the invention, if the player made the Aces-Up bet and the Ante bet and decides to fold, the Aces-Up bet is swept along with the Ante. In another form of the invention, if the player remains in the game by making the Play Bet and the player's hand does not contain a hand ranking of a pair of Aces or higher, and a bet was made on the Ace-Up wager, that wager may be now or later collected by the dealer. If the player determines that the rank of the best four-card poker hand that can be made from the five cards dealt to the player is sufficiently high as to warrant competition against the dealer (or if the player wants to 'bluff' against the dealer, particularly if the dealer must qualify), the player makes an additional wager, referred to as a play bet or game bet. That additional wager may be multiples of the Ante, such as 1×, 2×, 3×, 4× or 5× the amount of the original Ante, at the option of the player. In some examples of the invention, the game bet is 1× the ante unless the player has a qualifying hand such as a pair of kings or better for example. If the player's hand qualifies he has the option of increasing his bet. Fractional amounts or larger amounts may be allowed, but they can complicate the payout or alter the hold for the house, so those changes are in the discretion of the casino. After discarding excess cards and placing the Game Bet, or placing the fifth card face down, or merely leaving the fifth card in the hand so that the hand may be arranged and ranked by the dealer or player when exposed, the player's hand is placed on the table for display. The dealer's hand is then revealed after each and every player has determined whether or not the Game Bet is to be made. The dealer compares the value or rank of his hand against the value or rank of each player's hand, usually in succession around the table, and each series of wagers (the Aces-Up wager, the Ante and the Game Bet) is resolved. Ties on the rank of player's hands and dealers hands may be either paid to the player, called a push, or collected by the dealer, depending upon the desired house advantage the casino wants to build into the game. The dealer may either always qualify (a preferred method of play), or a level of qualification may be built into the game (such as at least Queen high, at least King high, at least Queen-Jack, At least King-Jack, at least Ace-King, or at least one pair).

Resolution on the wagers may be based upon pay tables for the Aces-Up wager, pay tables on the Ante, and/or the Game Bet. Preferred play of the game provides pay tables for one or more of the Aces-Up wager, the Ante and an automatic bonus payout on the ante. The Game Bet pays one-to-one with a player win. This differentiation is based upon the fact that with certain very high ranking hands, the player would be at an extreme advantage in placing a 5× Game Bet, assuring a very high multiple payout, with essentially no risk or little risk involved in the placement of the 5× Game Bet wager. The payout of wagers may be tailored by the casino by selecting pay tables designed for greater player payouts or greater casino earnings.

Although a four card poker game is a preferred form of the invention, the game could also be played with three, five or seven cards, with necessary adjustments to the pay tables.

For example, in a four card game, the hierarchy of hands is as follows:

Four of a Kind
Straight Flush
Three of a Kind
Flush
Straight
Two Pair
Pair
High Card.

A three or five card game would require a different hierarchy of hand rankings.

There are many variations of the game that may be played within the scope of the present invention. The following variations on the format described above shall be described in a manner that should enable those skilled in the art to appreciate the expanded scope of play available, rather than considering any single. described method as limiting the intended scope of the game.

Version I—

Each player receives 5 cards, and the dealer receives 6 cards. The players and the dealer identify their best four card poker hands, the players may rely upon the house for assistance, if needed. The dealer always qualifies, that is the dealer's hand and any players' hands are always in play if the ante bet is made. Players have the choice of placing one or both of the Ante Bet and a Bonus Bet (e.g., the Aces-Up wager). House rules may require the player to make the Ante Bet, the Bonus Bet, or both the Ante and Bonus Bet. The Ante wager is a wager directly against the rank of the dealer's hand, and the Aces Up Bonus Bet is a bet against a pay table. If after viewing his/her hand, a player chooses to stay in the game against the dealer (keeping the Ante wager in play), the player must make an additional Game Bet to stay in the game. This Game Bet may be, for example, 1 through 5 (1 through 4, or 1 through 3) times the amount of the initial Ante wager at the opinion of the player. In other forms of the game, the player's Game Bet must be 1× the ante unless the player holds a qualifying hand of a pair of Aces or better. If the player has a qualifying hand, he can bet up to 3× the Ante. Preferably, the player must hold a pair of aces or better to win on the Bonus Bet (hence the name 'Aces-Up'). The Bonus Bet preferably pays a maximum return of 50:1, but payouts may theoretically be as high as 500:1 for certain hands, such as for four Aces. The Bonus Bet side bet game may or may not be present in the rules of the game. In this example of the invention, the game pays an automatic bonus for certain high ranking hands according to a payout schedule. This bonus is paid on the Ante wager, and does not require the player to make a separate bet to qualify for this payout. For example, automatic bonuses are paid on three of a kind, straight flushes and four of a kind.

Version II—

Each player and the dealer gets five cards to make the best four-card poker hand. If the dealer's hand does not equal or exceed a certain rank (e.g., a pair of 2's or better), he discards all cards and draws a new five card hand, and then makes a four-card poker hand from the five cards. The player must make the Ante wager to be in the game against the dealer. The dealer always qualifies to play against the player. It is possible to allow the player or require the player to make the Ante wager 1) before the deal of cards, 2) after the deal of cards but before any cards are revealed, 3) after the deal of cards and after the players has reviewed his cards but before the dealer has exposed cards, 4) after the deal of cards and a partial or complete revelation of the dealer's five cards (but before review of the player's cards), or 5) after the deal of cards and a review of the players' cards and a partial revelation or complete revelation of the dealer's five cards, which play might be restricted to where the dealer has not qualified (but not after revelation of any sixth card). The player's hand may be required to exceed a minimum rank to bet more than 1× the Ante. For example, if the player has a qualifying hand of a pair of Kings or better, the player can make a Game Bet of 1×, 2× or 3× the Ante. As with Version I, the rules can provide that the Bonus Bet (side bet) is mandatory or both initial bets (the Ante and the Bonus Bet) are mandatory. The automatic bonus against a pay table on the Ante bet may or may not be present in the rules of the game. The Bonus Bet game may or may not be present, also in the rules of the game. In this example, a pair of aces or better qualifies the player for an Aces-Up payout of 1:1. The automatic bonus pays even if the player's hand is lower in rank than the dealer's hand.

Version III—

The players and dealer each receive five cards to make their best four-card poker hand. The betting/wagering rules and procedures are the same as in the previous versions, except for those listed below. Either the Ante is mandatory, the Ante or the Bonus Bet is mandatory, or both initial wagers are mandatory. The dealer must qualify to play (for example, with a hand of Ace high or better, King-Queen or higher, Ace-King or higher, pair of deuces or higher, etc.). The automatic bonus side bet game against a pay table is present in the rules of this example of the game.

If the player stays in the game, the player can bet 1× to 3× the Ante if the player has a qualifying hand of a pair of Kings or better. Otherwise, the maximum Game Bet is 1× the Ante. The lowest ranking hand that qualifies for the bonus payout is a pair of Aces or better.

Version IV—Four Card Poker with Super Bonus—

The dealer and each player are dealt five cards each. The cards are used to make the best four card poker hand by the players and the dealer. Players can make a bet against the dealer (Ante), a bet against the pay table (Aces-Up Bonus Bet) or both. House rules may require one or both bets to be mandatory. In addition, the players are required to make a Super Bonus bet in an amount equal to the Ante in this example of the invention.

Players place equal bets on the Ante and/or Super Bonus and/or Bonus spots on the layout. After viewing the cards, the player must fold or place an additional Bet (play wager). If the player's hand does not qualify with a pair of Kings or better, he must bet 1× the ante to an in the game. With a qualifying hand of a pair of Kings or better, he can bet an amount equal to or multiples of the Ante, such as 1×, 2× or 3× the Ante.

If the player has a higher ranking hand than the dealer's hand, the player is paid 1:1 on the ante and the play bet. If the dealer's hand outranks the player's hand, the player loses the ante and the play bet.

The player has the option (or may be required) at the beginning of the game to place an Aces-Up bonus bet. In this example of the invention, the player wins a bonus payout for a pair of Aces or better. If the player makes the Ante and Play bets and beats the dealer, but does not have a pair of Aces or better, the player pushes on the bonus bet. The player is always paid on the Aces-Up bonus bet, regardless of whether or not the player's hand beats the dealer's hand.

In addition, this example of the invention includes a mandatory Super Bonus bet that is made in an amount equal to the ante. The player wins a payout for certain high ranking hands such as a straight flush or four of a kind. A pay table is provided on the layout to identify winning hands and payout amounts.

A failure to obtain a "Super Bonus" hand does not result in an automatic loss of the bet.

For example, when the player's hand against the dealer does not qualify with a pair of kings or a straight flush or better, but the hand still beats the dealer, the Super Bonus bet pushes. But, if you fold on the ante or lose the ante and play bets against the dealer, the Super Bonus bet is also lost.

The Super Bonus bet is desirable in some instances where it is desired to provide the house with more of an advantage. In this example of the game, removing the mandatory Super Bonus bet causes the game to favor the player. However, other rule changes such as requiring the dealer to qualify, or raising the minimum qualification hand ranking when making the play bet are other means to shift the odds to favor the house.

There are a number of advantages in the game of the present invention. The fold rate on this game is approximately 21%, which is lower than the fold rate in other known games, such as Three Card Poker®. This feature is believed to attract and retain players, making the game more appealing to casinos.

Players win this game approximately 48% of the time, which exceeds the expectation of many players, and increases player appeal.

By varying the number of cards made available to the dealer and/or players, in forming the hands, by requiring the dealer's hand to qualify or by eliminating dealer qualification, by modifying the payouts and winning hand combinations possible on the bonus bet, by adding the Super Bonus bet etc., the payouts can be made to pay as high as 500:1 e.g., for four of a kind hands. This feature is believed to attract and retain more poker players.

Three Card Example

An aspect of the invention is a method of playing a wagering game, comprising the steps of: a) placing a first single part Ante wager to participate in a casino three-card poker-type game; b) each player placing a mandatory Blind wager; c) each player optionally placing a side bet Bonus wager against a pay table on attaining a predetermined rank in the first cards dealt to each player, d) a dealer dealing at least a partial hand of cards to each player who placed a first wager; e) resolving the side bet wager either before or after play of the underlying game against a first pay table, f) resolving each player's hand according to a predetermined hierarchy of poker-type game outcomes with respect to the underlying game and g) resolving the blind bet against the dealer's hand and a second pay table. Payouts are preferably made on the side bet wager when the player obtains a predetermined winning outcome. In one form of the game, all payouts on both the side bet wager and the underlying game pay odds (and/or a jackpot or progressive jackpot value). That is, all payouts are made in proportion to the amount wagered, with the higher ranking poker hands paying a higher payout multiple than the lower ranking hands. Payouts are made to the player on the blind bet wager when the player hand beats the dealer hand, and for one of a plurality of predetermined winning blind bet game outcomes. Payouts on the Ante are typically equal to the Ante bet. Payouts on the Play wager are also typically multiples of the Ante.

Payout odds typically are printed on the playing surface and are referred to as a "pay table". An exemplary pay table for a three card poker Bonus bet wager and Blind Bet wagers of the game of the present invention is outlined below:

| Hand | Bonus Payout Odds | Blind Payout Odds |
|---|---|---|
| Straight Flush | 40:1 | 100:1 |
| Three of a Kind | 30:1 | 20:1 |
| Straight | 6:1 | 2:1 |
| Flush | 4:1 | 1:1 |
| Pair | 1:1 | |

The standard poker rankings in five card poker type games are presented in the following descending order: Royal flush, straight flush, four of a kind, full house, flush, straight, three of a kind, two pair and a pair. According to a three card game of the invention, four of a kind, full house and two pair are not included in the pay table as those outcomes require more than three cards. In three card poker, the order of certain hands (flush, straight and three of a kind) is inverted as compared to five card poker. The change in ranking is dictated by the frequency of occurrence of those hands. Although the minimum winning card combination in the three card example is a pair, the invention contemplates other minimum hands, such as a single face card or a high ranking pair, such as a pair of 10's or better. Four card, 6 card and seven card games would necessarily have different winning hands and hierarchies. The present invention contemplates games consisting of 2, 3, 4, 5, 6 and 7 card poker hands.

Payout methods may include fixed amounts (regardless of the amount wagered), odds payouts (payment of the amount wagered times the pay table multiple), or a percentage of a jackpot or a jackpot amount. The pay table may contain one or a combination of different payout methods, according to the invention.

Predetermined winning poker outcomes have proportional payout odds. "Odds" in this context means payouts that are proportional to the player's wagers (that is, multiples of the wagers), not progressive payouts, fixed payout amounts or payouts that are part of or an entire pot.

According to an example of the present invention, the above-identified step defines some, but not necessarily all of the entire game play method. Additional steps and wagers may be added, such as progressive jackpot wagers, wagers against the table (e.g., player banked wagers for one-on-one player versus player competitions) and automatic odds bonus payouts, for example.

The dealer may also act as banker. The player's cards may be dealt unseen or seen. The cards preferably form a standard 52-card deck, although one or more wild cards (such as a joker(s)) may be used. The hand typically consists of three cards, but in some instances, it might be desirable to deal the players one or more additional cards, and allow the player a discard to arrive at the best three card hand, with appropriately lower pay table odds provided. In another example of the invention, players receive three cards, but have the option to discard one or more cards and have them replaced with additional cards, forming a three card "draw" hand. An additional wager to pay for the draw card may be required. In yet other examples of the invention, the player receives four cards to make a best four card hand, receives five or six cards to make a best four card hand, receives five cards to make a best five card hand, receives six or seven cards to make a best five card hand, and so on and so forth. Extra cards can be dealt to form a final hand of between two and seven cards. The number of cards dealt to the dealer can exceed or be less than the number of cards dealt to the players.

In the case of one exemplary three card version of the game of the present invention, hands are preferably ranked as follows, where A=ace, K=king, Q=queen, J=jack and numbers 10 to 2 designate the other cards:

Highest:
- STRAIGHT FLUSH: Three cards of one suit in sequence
  - AKQ highest ranking brag
  - KQJ next highest ranking brag
  - QJ10 next highest ranking brag, and so on until
  - 32A lowest ranking brag
- TRIPS: Three cards of one Rank
  - AAA highest
  - KKK next highest ranking trips, and so on, until
  - 222 lowest ranking trips
- RUN: Three cards of mixed suits in sequence
  - AKQ highest ranking
  - KQJ next highest ranking, and so on, until
  - 32A lowest ranking
- FLUSH: Three cards of One Suit
  - AKJ highest ranking
  - AK10 next highest, and so on, until
  - 532 lowest ranking
- PAIR: Two cards of the Same Rank
  - AAK highest ranking
  - AAQ next highest ranking, and so on, until
  - 223 lowest ranking Lowest:
- HIGH CARD (a hand comprising none of the above combinations)
  - AKJ highest ranking
  - AK10 next highest ranking, and so on, until
  - 532 lowest ranking Ace is high, but can be low in 3-2-A Sequence.

Those skilled in the art will appreciate that various other names may be used for the hands in the illustrative hierarchy set forth herein. Other hierarchy's are contemplated. For example, TRIPS may also be known as three of a kind or PRILE; and a RUN may also be known as a STRAIGHT.

The Bonus payout may be made in accordance with a predetermined scale. For example, one possible payout scheme is as follows:

| | | |
|---|---|---|
| Straight Flush | 40 to 1 | (Range of 25 to 100 to 1) |
| Three-of-a-kind | 30 to 1 | (Range of from 10:1 to 50:1) |
| Straight | 6 to 1 | (Range of from 4:1 to 12:1) |
| Flush | 4 to 1 | (Range of from 3:1 to 12:1) |
| Pair | 1 to 1 | (Range of from 1:1 to 3:1) |
| High Card Rank | 0.5 to 1 | (Range of from 0.2:1 to 1:1) |

The payouts may be at different rates that are proportional to the original wager, but not necessarily whole number multipliers, such as 2 to 1 or 14 to 5 for a pair. Those skilled in the art will appreciate that the payouts may be varied without departing from the scope of the present invention. In other forms of the invention, at least some of the payouts are fixed in amount regardless of the amount wagered, are a percentage of a jackpot or progressive jackpot amount. Payouts with multipliers that are not whole integers are better suited for video game formats, where payouts are automatically calculated and dispensed. Blind bets payout odds may similarly vary.

The method may further comprise the step of permitting or requiring a player to place a wager on a fixed or variable extra bonus jackpot, but this feature is not desirable in some instances. For example, when a game is offered in a California card room, players bank the game. With regard to player banking, in order for players to feel they can afford to bank a particular game, the payout odds must be kept low enough to prevent players from avoiding their turn being the banker. The bonus payouts may therefore be eliminated in player-banked versions of the invention. Typically, higher payout odds are acceptable in a more traditional Las Vegas style casino where the house banks the game. Corporations may also bank the games. In the case of a corporation, an employee of the corporation will typically play the game and act as banker on behalf of his employer. According to the present invention, the game may be played as a player banked game, which includes corporate and individual player banking, or as a traditional house banked casino game.

Another embodiment of the present invention comprises the steps of: designating at least one playing card indicia as a wild indicia; placing a single part Ante wager to participate in a casino three-card poker-type game; placing a blind wager that wins when the player hand beats the dealer hand and has a predetermined winning rank; a dealer dealing a hand consisting of three cards to each player who placed the wagers; and playing a three-card poker-type hand wherein said wild indicia is used where present in any of said hands; resolving each player's hand according to predetermined poker rules, wherein at least some payouts proportional to the single part wager are made for obtaining a predetermined winning hand.

In an embodiment of the present invention, each player receives two standard playing cards plus a wild card that the player combines with the standard cards to make a best three-card hand. The payout scale and predetermined ranks may be chosen or modified to reflect the increased probability of a high ranking hand being produced. The wild card can be any card in one form of the invention. In other forms, the wild card can be restricted to certain uses, such as completing a flush, or Aces only being equal to a 1, for example. A common wild card or a common card may also be used, again with pay tables modified to reflect the increased potential or at least changed potential for higher ranked hands.

Such wild cards serve to add excitement and create higher hand values. Wild cards could also be designed to be retained permanently by players and if decorated appropriately by an issuing casino or the like would serve the dual purpose of a playing card and a promotional item. Wild cards may be used in this way in conjunction with other forms of card games. Alternatively, the wild card can be printed on the player area of the layout.

According to the invention, when the player participates in a three card poker game against the dealer, he is required to place an additional third "play" wager to stay in the game. This third wager may be smaller, larger or equal to the amount wagered against the dealer, but is equal to the ante in one example of the invention. Preferably, the player is permitted to view his three card hand prior to deciding whether to make the Play wager or fold. In another form of the game, the player is optionally permitted to make the third wager after viewing his cards, but is not required to fold if he elects not to make the third wager.

An optional feature of the invention is paying an automatic bonus payout on either the ante bet, or the ante bet and additional play bet (both against the dealer's hand) if the player's hand is one of a predetermined number of high-ranking winning hands. For purposes of this disclosure an "automatic bonus" is defined as an extra bonus payout that does not require a separate wager. For example, the player may receive an automatic bonus payout when he has a straight flush. Preferably, no additional bet is required to collect on the bonus bet. In other examples of the invention, a bonus bet is required, and the bonus pays odds according to a pay table of winning outcomes and corresponding payout multiples.

Although odds payouts (with or without making a bonus bet) on the bonus is a preferred form of the invention, certain high ranking hands may pay a fixed payout, a random payout, a proportion of a pot or a progressive payout.

It might be necessary to distribute more than three cards to the dealer, or players and allow the dealer and/or players to use the extra card to make the best three card hand. This dealing modification might be necessary to improve or reduce the house's odds, depending on the other game rules selected. The second bet and bonus bets may be required or optional, depending on house rules.

The present invention is also a method of playing a wagering game, comprising: a player placing at least one Ante wager to participate in the game, wherein the player optionally places a Bonus wager (pair plus) that his hand will contain one of a plurality of predetermined winning card combinations, a player placing a mandatory Blind wager that his hand will contain a card combination higher in rank than a rank of a dealer hand and will be a predetermined winning combination; dealing at least three cards to the player; the player making play wager that is a multiple of the Ante to stay in the game, the multiple selected by the player; dealing at least three cards to the dealer; and resolving the hands according to a predetermined hierarchy of poker hands.

According to one aspect of the invention, the player may optionally play the game against the dealer, the game against a pay table or both during each round of play. In other examples of the invention, additional different games are combined with one or more of the game segments (against the dealer and/or against a pay table). For example, the game rules could allow the player to place an additional bet on the occurrence of a five card hand against a pay table, where the dealer deals the player two additional cards after the three card hand against the dealer and/or against the pay table is complete. Although the specific type of additional game and the number of cards needed is unimportant to the invention, the use of the original three cards with or without adding more cards to play an additional game is contemplated.

In yet another alternative three-card embodiment of the present invention, the dealer is required to have a qualifying hand to continue the normal game play. This qualification requirement may represent a minimum ranking, or a maximum ranking, or both. For example, the rules might require the dealer to have at least a minimum of a single queen (queen high) in order to qualify to play against the player. In one example of the invention, the Ante and Play bets of the multiple part wager are a push when the dealer does not qualify. In another example of the invention, the Ante pays 1:1 and the Play bet is returned when the dealer does not qualify. In yet another form of the invention, the Play bet is paid odds as a bonus payout if the hand is a predetermined winning hand regardless of whether or not the dealer qualifies. In yet another example of the invention, the dealer is required to reveal at least one card to the players, and the players are also permitted to view their own three card hand prior to deciding whether to place the Play bet.

When the player wins the game against the dealer, the dealer or banker typically pays 1:1 odds on the Ante and Play bets. In other examples of the invention, higher or lower payouts are made on either the second bet or the third bet, or a combination of the bets.

According to one example of the invention, an additional automatic bonus payout is made when the player's hand against the dealer is one of a predetermined high ranking arrangements of cards. No additional bet is required, and the bonus payout may be paid against the Ante, Play or both bets. An exemplary pay table that pays odds on the Ante bet for certain automatic bonus hands is shown below:

| Hand | Payout Odds |
|---|---|
| Straight Flush | 5:1 |
| Three of a Kind | 3:1 |
| Straight | 1:1 |

In yet another form of the invention, the dealer and player hands may be combined to form the best three, four, five or six card bonus hand. In one example of the invention, a bonus amount is paid for the best five card hand made from the dealer's and player's three cards each.

The invention also provides game apparatus for use in playing the card-type games of the present invention. For example, the games of the present invention may be played on a live gaming table. For example, one aspect of the present invention comprises an apparatus for playing a card-type game comprising: display element (e.g., board, screen, table cards, play sheet, etc.) for informing at least one player of a hierarchy of a plurality of possible hands and a predetermined plurality of winning card combinations and corresponding payout odds; an area or position for receiving at least one wager selection from a plurality of wagering options by at least one player, wherein the wagering comprises whether a player's hand attains at least one of said predetermined plurality of winning combinations; and a surface or display area for displaying a plurality of indicia of playing cards to form at least one player's three-card hand.

The apparatus may also incorporate a chip tray to receive playing chips, the chip tray being placed in a position adjacent to or otherwise convenient to the dealer. The apparatus may incorporate an area or receptacle for cards not in play and a shuffler and card shoe. The apparatus may comprise a rigid playing surface of board, plastic or other suitable material or may comprise a cloth or other flexible material defining a playing surface. A cloth playing surface is commonly referred to in the industry as a layout.

According to a preferred embodiment of the present invention, the three wager amounts (Ante, Bonus and Blind Bets) are independent, so that a player may wager unequal amounts on each bet. In an alternative variation of the game, the Ante, Blind and Bonus bets have a prescribed relationship. For example, the Ante and Blind bets must be equal, or all three bets must be equal.

After the above wagers are placed, the dealer preferably shuffles the cards (manually or otherwise) and then deals a three-card hand to each player and to himself. The cards may initially be dealt to the players face-up or face-down depending upon casino policy. All the dealer's cards are dealt face-down in this preferred embodiment.

After the cards have been dealt, the player inspects his hand and determines whether he wishes either to forfeit his Ante wager and not to play the hand, or to continue. If he wishes to continue, according to this illustrated embodiment, he must place a Play wager, which is a multiple of the Ante, preferably 1-10× the Ante and most preferably 1-3× the Ante at the option of the player.

If a player has only made Ante and Blind wagers and decides not to make a Play wager, he forfeits his Ante and Blind wager, which are taken by the banker and the player's cards are discarded before the game proceeds. If the player has also placed a Bonus wager, that wager is not affected, but the player must make a Play wager if he has a winning Bonus wager.

At this point, the dealer then reveals his cards and arranges the cards to show the value of his hand. The dealer then in turn reveals each other player's hand (if not already visible) and resolves each player's wager(s). In one embodiment of the present invention, players preferably place two initial wagers of equal amounts. One of these two initial wagers is referred to hereinafter as the Ante, while the other is referred to hereinafter as the Blind wager. In a preferred version of this embodiment, players also have the option to place a PAIR PLUS (or Bonus) wager as described above.

After placing the initial wagers, the dealer (or player-banker, if applicable), and each player receive three cards. In the preferred version of this embodiment, the player is only allowed to view his or her hand. In an alternative version, the players cards may be made known to each other and/or one or more of the dealer's cards may be made known to the players. After viewing their respective hand, each player may either fold (i.e., surrender both the Ante and the Blind wagers) or continue playing the game by placing a Play wager. In a preferred version of this embodiment, the Play wager must be placed by any player wishing to continue playing the game to the final outcome.

In this preferred version, the Play wager is a player-selectable multiple of the Ante wager. In one example of the invention, restrictions are placed on the player's multiple selection. For example, the player may only be allowed to select a multiple based upon the rank of the player's respective three card hand. For example, if the player has a hand of a rank which is less than a pair, the player may only be allowed to place a Play wager which is equal to the original Ante wager, whereas if the player has a hand of a rank which is a pair or better, the player may be allowed to place a Play wager which is equal to one, two or three times (i.e., 1×, 2× or 3×) the Ante wager. Placing a Play wager of two times the Ante wager may also be referred to as "doubling down," while placing a Play wager of three times the Ante wager may also be referred to as "tripling down."

As previously mentioned, in one version of the invention, the dealer's cards are revealed after all players have made their respective decisions to either fold or place the Play wager. One preferred version of the game additionally requires that the dealer's hand be of a minimum ranking for all wagers not already surrendered to remain viable, or "in action." This is referred to herein as dealer qualification. For example, in the preferred version, if the dealer's hand has a rank of less than Queen-high, the dealer's hand does not qualify. Thus, some wagers may be returned to players, that is, these wagers push. If the dealer's hand has a rank of Queen-high or better, the dealer qualifies and all wagers are in action.

In the preferred version, if the dealer does not qualify, the Ante wager pushes and all remaining wagers (i.e., the Blind and Play wagers) remain in action. The outcome of any wagers in action is determined by a comparison of the dealer's hand rank with the rank of each player's hand. If the dealer's hand rank is greater than the player's hand rank, the player loses all wagers remaining in action. If the player's hand rank is greater than the dealer's hand rank, the player is paid even money on the Ante (assuming the dealer qualifies as described above) and Play wagers.

The blind wager pays based on the player's hand rank achieved, and also when that player's hand outranks the dealer's hand. In the preferred version of this embodiment, a predetermined pay table is provided which contains the winning criteria or hand ranks and corresponding mathematical relationships or payout odds. The mathematical relationships may be expressed in multiples of the Blind wager, all or a portion of a progressive jackpot or preset amounts. The pay table is preferably displayed as a schedule listing each winning hand rank and the corresponding multiple of the Blind wager to be applied should a player achieve a hand of a winning hand rank which also outranks the dealer's hand. This schedule may be varied in accordance with rules of the game and/or by the casino.

In the preferred version, if the player's hand rank is greater than the dealer's hand rank, but does not satisfy any of the predetermined winning criteria, the Blind wager pushes, that is, the Blind wager is returned to the player. Also, if the dealer qualifies and the player and dealer have hands of equal rank, the Ante, Play and Blind wagers all push, even if the player's hand satisfies one of the winning criteria.

An exemplary Pay Table for use in conjunction with a preferred version of this embodiment is shown below. Many other pay table ranks and corresponding payout odds can be used, especially if the game is a four or five card variant. The below Pay Table lists the winning criteria for the Blind and Bonus wagers along with the corresponding multiples to be applied thereto in determining the payout. In this embodiment, The hand ranking order is as follows: royal flush (suited Queen, King and Ace), straight flush, three of a kind, straight, flush and pair.

Pay Table

| Player's Hand Rank | Blind | Bonus |
|---|---|---|
| Royal Flush | 100 to 1 | 50 to 1 |
| Straight Flush | 20 to 1 | 40 to 1 |
| Three of a Kind | 10 to 1 | 30 to 1 |
| Straight | 2 to 1 | 6 to 1 |
| Flush | 1 to 1 | 4 to 1 |
| Pair | NA | 1 to 1 |

The following description is intended to provide examples of a game played according to one version of this embodiment using the above pay table in order to determine the winning criteria and payout amounts for the Blind and Bonus wagers. The examples involve a scenario including four players having placed wagers, and received and played hands as shown in Tables 1 and 2 and described below.

TABLE 1

| Player | Ante | Blind | PAIR PLUS | Player's Hand | Play |
|---|---|---|---|---|---|
| 1 | 20 | 10 | 20 | Queen♥ Jack♥ Ten♥ | 3X Ante |
| 2 | 50 | 10 | 15 | Five ◇ Ace ♥ Eight ♣ | ○ |
| 3 | 10 | 5 | 5 | Nine ♣Nine ♥ Four♠ | 2X Ante |
| 4 | 100 | 50 | 50 | King ◇ Nine ♣Eight ♥ | 1X Ante |

In the preferred version of this embodiment, players must decide whether to place the Play wager to continue playing the game or fold, without knowledge of any cards forming the dealer's hand. Additionally, players in the preferred version may place a Play wager of up to 3 times the Ante wager only if that player has a hand ranking of a pair or greater. As shown in Table 1, Player 1 has a straight flush and Player 3 has a pair, thus these players may place a Play wager of up to 3 times their respective Ante wagers. Player's 2 and 4 have hands which rank less than a pair, therefore these players may only place a play wager which is equal to their respective Ante wagers. The player's decisions are shown in Table 2 below.

TABLE 2

| Player | Ante | Blind | Bonus | Player's Hand | Play |
|---|---|---|---|---|---|
| 1 | 20 | 10 | Win 800 | Queen♥ Jack♥ Ten♥ | 60 |
| 2 | 50 | 10 | Lose 15 | Five ◇ Ace ♥ Eight ♣ | Fold |
| 3 | 10 | 5 | Win 5 | Nine ♣Nine ♥ Four♠ | 20 |
| 4 | 100 | 50 | Lose 50 | King ◇ Nine ♣Eight ♥ | 100 |

As shown in Table 2, Player 1 wins $800 (40 times $20) on the Bonus wager based on the Pay Table formula of 40 to 1 associated with a straight flush as the winning criteria. Players 2 and 4 lose their respective Bonus wagers. Player 3 wins $5. With regard to continuing the poker game, Player 1 placed a Play wager for three times the ante. Player 2 folded, thus forfeiting the Ante and Blind wagers. Although Player 3 could have placed a Play wager of three times his or her Ante amount of $10, Player 3 instead opted to place a Play wager of twice the Ante ($20). Player 4 placed a Play wager equaling the Ante wager. It should be noted that Player 4 could not have placed a higher Play wager because Player 4 did not have a hand with a pair or better.

EXAMPLE 1

In this example, the dealer's hand is revealed to be:
Queen ♣Queen ♥ Three♠

The outcome of the wagers are shown in Table 3 below.

TABLE 3

| Player | Ante | Blind | Player's Hand | Play | Final Outcome (w/o PAIR PLUS) |
|---|---|---|---|---|---|
| 1 | Win 20 | Win 200 | Queen♥ Jack♥ Ten♥ | Win 60 | Win 280 |
| 2 | Lose 50 | Lose 10 | Five ◇ Ace ♥ Eight ♣ | Fold | Lose 60 |
| 3 | Lose 10 | Lose 5 | Nine ♣Nine ♥ Four♠ | Lose 20 | Lose 35 |
| 4 | Lose 100 | Lose 50 | King ◇ Nine ♣Eight ♥ | Lose 100 | Lose 250 |

The dealer qualifies with a pair, thus all bets are in action. Player 1 makes a play wager equal to 3× the Ante. Player 1 holds a straight flush and wins on the Ante (1:1), Play (1:1) and Blind (20:1 according to the Pay table) wagers. Player 2 lost both Ante and Blind wagers as a result of folding rather than placing a Play wager prior to the dealer's cards being revealed. Player 3 has a hand with a lower ranking (i.e., a pair of nines versus the dealer's pair of queens) than the dealer's qualifying hand and thus loses the Ante, Blind and Play wagers. Player 4 also has a hand with a lower ranking than the dealer's qualifying hand and thus loses the Ante, Blind and Play wagers.

EXAMPLE 2

The dealer's hand is revealed to be:
Queen ♣Six ♥ Three♠

The outcome of the wagers are shown in Table 4 below.

TABLE 4

| Player | Ante | Blind | Player's Hand | Play | Final Outcome (w/o PAIR PLUS) |
|---|---|---|---|---|---|
| 1 | Win 20 | Win 200 | Queen♥ Jack♥ Ten ◇ | Win 60 | Win 280 |
| 2 | Lose 50 | Lose 10 | Five ◇ Ace ♥ Eight ♣ | Fold | Lose 60 |
| 3 | Win 10 | Lose 5 | Nine ♣Nine ◇ Four♠ | Win 20 | Win 25 |
| 4 | Win 100 | Lose 50 | King ◇ Nine ♣Eight ◇ | Win 100 | Win 200 |

The dealer qualifies with a Queen-high, thus all bets are in action. Player 1 with a straight flush wins on the Ante (1:1), Play (3:1) and Blind (20:1 according to the Pay Table where a straight flush is the winning criteria) wagers. Player 2 loses both Ante and Blind wagers as a result of folding rather than placing a Play wager prior to the dealer's cards being revealed. Player 3 has a hand with a higher ranking than the dealer's qualifying hand (i.e., a pair of nines versus the dealer's Queen-high), and thus wins the Ante and Play wagers, but loses on the Blind because Pairs are not a winning criteria listed on the Pay Table. Player 4 has a hand with a higher ranking than the dealer's qualifying hand (i.e., King-high versus the dealer's Queen-high), and thus wins the Ante and Play wagers, but loses the Blind wager because King-high is not a winning criteria listed on the Pay Table.

EXAMPLE 3

In this example, the dealer's hand is revealed to be:

Ten ♣Four ♥ Five♠

The outcome of the wagers are shown in Table 5 below.

TABLE 5

| Player | Ante | Blind | Player's Hand | Play | Final Outcome (w/o PAIR PLUS) |
|---|---|---|---|---|---|
| 1 | Push | Win 200 | Queen♥ Jack♥ Ten♥ | Win 60 | Win 280 |
| 2 | Lose 50 | Lose 10 | Five ◇ Ace ♥ Eight♠ | Fold | Lose 60 |
| 3 | Push | Lose 5 | Nine ♣Nine ♥ Four♠ | Win 20 | Win 15 |
| 4 | Push | Lose 50 | King ◇ Nine ♠Eight ♥ | Win 100 | Win 50 |

Since the dealer's hand rank is less than Queen-high, the dealer does not qualify. Thus, all Ante wagers push, except for Player 2, who loses the Ante and Blind wagers as a result of folding instead of placing a Play wager. Although the dealer has a non-qualifying hand, in this preferred version the Blind and Play wagers remain in action. Player 1 with a straight flush wins on the Play (1:1) and Blind (20:1 according to the Pay Table) wagers. Player 3 has a hand with a higher ranking than the dealer's non-qualifying hand, and thus wins the Play wager but loses on the Blind because Pairs are not a winning criteria listed on the Pay Table. Player 4 has a hand with a higher ranking than the dealer's non-qualifying hand, and thus wins the Play wager but loses the Blind wager because King-high is not a winning criteria listed on the Pay Table.

Figure 1B:
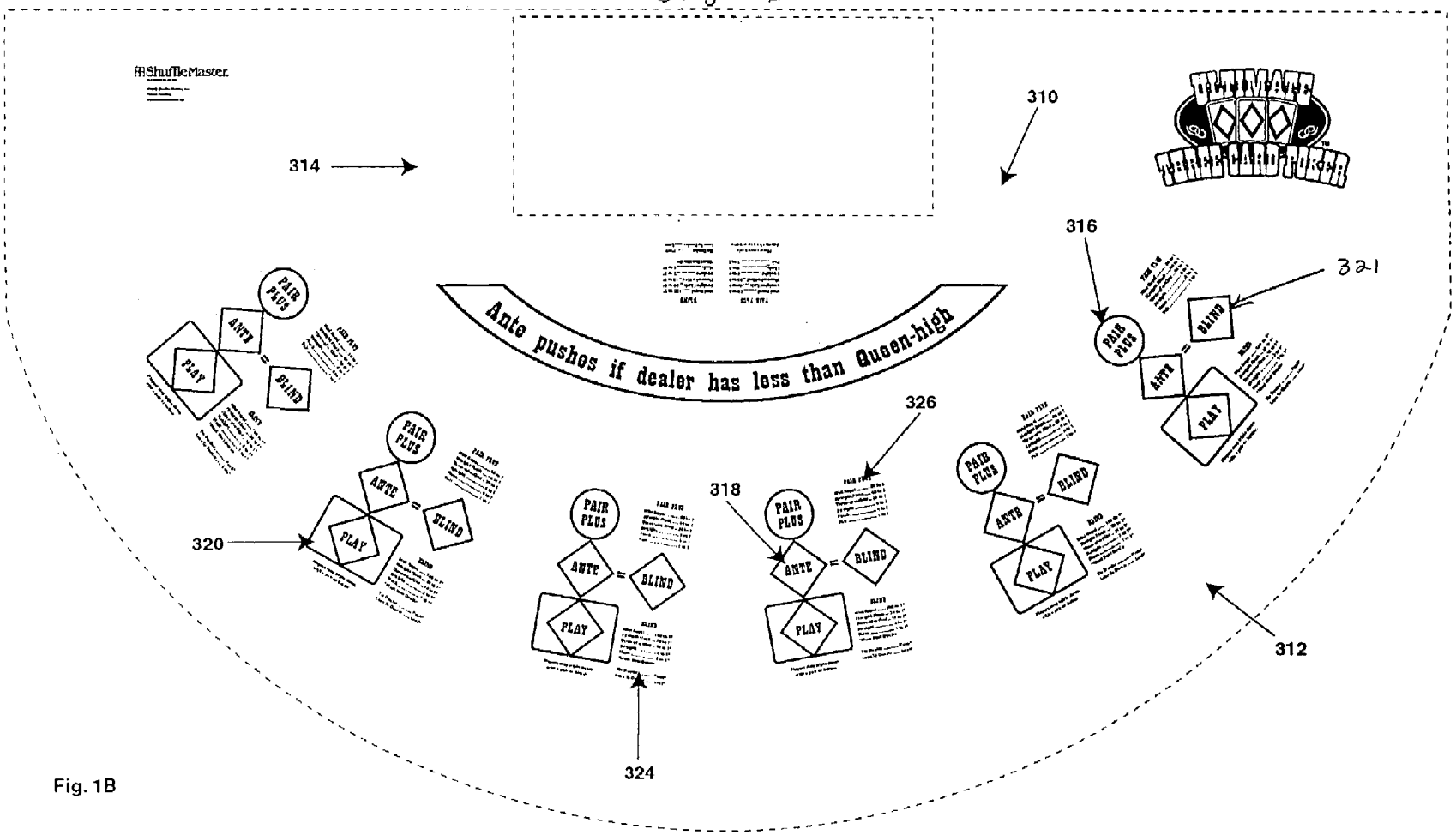
FIG. 1B shows a playing surface for use in playing a card game of a three card embodiment of the game of the present invention.

FIG. 1B illustrates a playing surface or table layout 310 on which the above preferred embodiment of the present invention may be played. Layout 310 may be marked or placed on any suitable surface such as a gaming table. For example, the layout may be in the form of a layout cloth supported on a supporting surface. In general, the invention can be practiced on existing casino tables, thus providing casino operators with additional revenue generating features without requiring extra casino tables, space, or game surveillance.

Layout 310 provides a playing area 312 for a plurality of players, for example seven players, and a separate area 314 for a dealer, or banker that also acts as a dealer. Each playing area 312 has a number of marked sections or zones 316, 318, 320 and 321 for the player to place various wagers as will be described hereinafter. Layout 310 also displays various payout schedules 324 and 326. Other wager areas and/or information can be displayed on layout 310, such as the "Ultimate Three Card Poker" promotional markings.

Each player takes a place at one of the areas 312. The game is played in a number of rounds as will be described. In each round, each player plays against the dealer and optionally wagers on the rank of his hand. The game can be played with a standard 52-card deck or a modified deck.

At the commencement of a game, each player who decides to play a particular round of the game must wager on the value of that player's hand against that of the dealer (Ante wager) and may place an optional wager (Bonus wager). Each player makes an Ante wager by placing an appropriate wager, such as a toke (or chip), in section 318 of his playing area 312. In one form of the invention, the Blind wager is mandatory and must equal the Ante wager. Therefore, each player must also place an amount in the Blind wager section 321 of his playing area 312 which equals the amount placed in the Ante wager section 318 of his playing area 312. If the player wishes to make the optional Pair Plus wager based on the value of his hand, he places an appropriate toke (or chip) in section 316 of his playing area 312. In the present example, the rules of the game provide that payouts will be made according to displayed payout schedules 324 (Blind wager winning criteria and payouts) and 326 (Pair Plus winning criteria and payouts). In one example of the invention, the pair plus wager is equal to the Ante. The amount may vary.

One example of three card rankings is included above. Additionally, for hands other than three cards, rankings would be suitably changed as would predetermined ranks and payouts. One skilled in the art will appreciate that other rankings can be practiced with the invention and that various other names may be used for the hands in the illustrative hierarchy set forth herein. For example, Straight Flush may also be known as a Brag or Bouncer, Three of a Kind may also be known as Trips or Prile; and a Straight may also be known as a Run.

The payout schedule may be varied in accordance with rules of the game and/or by the casino. One skilled in the art would appreciate that payouts may be varied without departing from the scope of the invention.

The payout schedules are preferably displayed in a convenient manner and location. The details of payouts and any other payouts (e.g., extra bonus) may be marked on each player's playing area 312 as illustrated in FIG. 1B. However, alternative arrangements can be used with the invention.

According to a preferred embodiment of the present invention, the two wagering options are independent, so that a player may wager unequal amounts on the Ante/Blind and Pair Plus options. In an alternative variation of the game, the Ante/Blind and Pair bets have a prescribed relationship. For example, the maximum Pair Plus wager may be double the Ante wager.

After the above wagers are placed, the dealer preferably shuffles the cards (manually or otherwise) and then deals a three-card hand to each player and to himself. The cards may initially be dealt to the players face-up or face-down depending upon casino policy. All the dealer's cards are dealt face-down in the preferred version of this embodiment.

After the cards have been dealt, the player inspects his hand and determines whether he wishes either to forfeit his Ante wager and not to play the hand, or to continue. If he wishes to continue, according to this illustrated embodiment, he must place a Play wager, which must be of proportionate value to and is preferably the same as the Ante wager. The Play wager is made by placing an appropriate toke (or chip) in section 320 of his playing area 312. After making the Play wager, the player places his cards in the area below section 320.

If a player decides not to make a Play wager, he forfeits his Ante and Blind wagers, which are taken by the banker/dealer and the player's cards are discarded before the game proceeds. If the player has also placed a Pair Plus wager, that wager is not affected, but the player must make a Play wager if he has a winning Pair Plus wager.

At this point, the dealer then reveals his cards and arranges the cards to show the value of his hand. The dealer then in turn reveals each other player's hand (if not already visible) and resolves each player's wager(s).

If the dealer does not have a hand with a rank of Queen high or better, the Ante wager is refunded to each player having placed a Play wager. This rank may be varied in accordance with rules of the game or of the casino. If the dealer has a Queen high hand or better, each player's hand is compared with that of the dealer. If the player's hand is higher (i.e., the rank of the player's hand exceeds that of the dealer's hand), the player is paid even money on both Ante and Play wagers. If the player's hand is lower, the player forfeits his Ante, Blind and Play wagers. If the dealer and player have the same hand, the Ante, Blind and Play wagers push.

Players who have also wagered on the value of the hand (i.e., Pair Plus wagers) win if the hand is at least a Pair, and are paid by the banker/dealer according to the posted scale (e.g., schedule 326 of FIG. 1B). These payouts are independent of the results of the game against the dealer.

This procedure completes a single round of the game. Play then continues in another round, with players commencing by making Ante and optional Pair Plus wagers.

In accordance with the present invention, a method and system configured for simulating a live table game typically played in a casino and adapted to provide interactive game play, including receiving real-time wagers from one or more live game players and presenting representative game hands without involving physical playing cards, physical wagering chips or currency or live casino personnel such as dealers. Systems of the present invention, such as a multi-player platform, can be constructed, modified, or retrofitted in accordance with the present invention.

The game of the present invention can also be in the form of an executable program played on a computerized apparatus or system which may be integrated with one or more multimedia transceiving terminals. It should be readily apparent to those skilled in the art that a system in accordance with the present invention can include various computer and network related software and hardware, such as computer language programs, operating systems, memory storage devices, input/output devices, data processors, servers with links to data communication systems, wireless or otherwise, such as those which take the form of a local or wide area distributed computing network, and a plurality of data transceiving terminals within the network, such as personal computers, PDA's (personal data assistant) or otherwise. It should be understood that the system of the present invention may also include multiple, redundant or backup devices of those described herein. Those skilled in the art will further appreciate that, so long as its users are provided with access to a system and the ability to play the game according to the present invention, the type of network, software or hardware is not vital to its full implementation.

In an exemplary embodiment, the core functional components of a game system of the present invention include a database, processor, and one or more graphical user interfaces. One exemplary system can be configured to function as a free standing terminal but may also be configured provide the game of the present invention to a plurality of players via the world wide web.

Another exemplary system includes servers and processors for conducting game play and one or more portable devices having input and output interfaces supported thereon. The portable devices and servers are preferably configured to communicate via wireless connection. The servers and portable devices can be configured to transfer financial information, game selections, game play information and game results and present information to the user as necessary through a graphical user interface included in the portable device.

The system provides game play to players through graphical user interfaces which preferably include data entry terminals and monitors that provide visual depictions of the game as play ensues. The data entry terminals are preferably adjacent the monitor and can include buttons, touch screens, voice responsive actuators or any other device for indicating a preference.

The data storage device, which contains the programming, game rules, predefined criteria, wagering and payment information, among other data relating to operation of the game in accordance with the present invention, is operatively associated with one or more analytical processors by a control program. Programs in the system of the present invention may contain an instruction set written in a conventional computing language such as HTML, C++ or Java, etc., for coordinating the interactive relationship between the data storage device, processor and graphical user interface.

The game play on the system of the present invention is preferably initiated by the player placing one or more wagers. The wagers can be placed by the player inserting money into a specially configured receiving slot in the data terminal or electronically from a credit card or ticket inserted into a reader or by inputting credit information into the system of the present invention via user interface. The wager amount is temporarily stored in the data storage device. The system accesses the game rules from the data storage device and game play continues according to the game rules.

During the game, the system may provide options to the player, receive selections, and compare existing circumstances in the game with any predefined criteria set in storage, such as a pay table with mathematical formulas or other such relations for prescribing payment on an optional side bet, to determine if any such criteria are satisfied. The game play continues until the final outcome is reached. Any winning hands are paid and the system restarts or otherwise readies itself to receive wagers for a new game.

Games according to the present invention may be implemented as live table games, television or cable game show game, video poker gaming machine platforms, hand-held games for play, multiple player interactive wagering platform games (with kiosk formats, single player screens, community screens, and/or banks of seats for players with a common dealer screen), cell phone games, games downloadable from the internet, parlor games, games executed on personal computers, palm pilots, play stations, wireless devices and the like. Each of the above game formats, among others, is contemplated.

In another embodiment, a game in accordance with the present invention is provided in a multi-player platform configured to simulate a live table game. The platform of the present invention is adapted to provide interactive game play, including receiving real-time wagers from one or more live game players and presenting representative game hands without involving physical playing cards or live casino personnel such as dealers. The multi-player platform, can be constructed, modified, or retrofitted in accordance with the present invention. Examples of known multiple player platforms are described in U.S. Pat. No. 6,607,443 and in U.S. application Ser. No. 10/764,827, filed Jan. 26, 2004 and published as U.S. Publication No. 2005/0164759. The content of these disclosures are hereby incorporated by reference in their entirety.

Preferably, a multi-player gaming system that can be used to practice the method of the present invention comprises a table and an upright dealer "virtual" video display system positioned for view by players seated at the table. The table may seat at least two players up to the amount of players that can be configured about the table and have a view of the dealer video display system. Typically each gaming system will have at least four player available positions, with space determinations considered as to whether there would be 4, 5, 6 or 7 player positions. It is possible to have a completely circular dealer display (e.g., holographic display in a cylindrical centerpiece) and have players distributed around the entire periphery, but this is too dissimilar to standard play arrangements and could slow the game down, as play should approximate that of a live game, with players playing in sequence. A surface of the table will include a display surface for showing all player hands, community cards, dealer hands and any other cards used to play the game for any purpose, and, chips or other wagering designations. Alternatively, player hands can be displayed on a separate player station screens. The table surface may include push button and or touch screen player controls, with our without other display features specific to the individual player. For example, the individual player screen may show a running history of wins/losses, credits available, credits bet and other play options. A majority of the table surface comprises a video monitor in one example of the invention. A separate player screen with touch screen controls or separate player control panels maybe provided at each player station near the continuous display surface.

The use of a common display surface offers some significant advantages in simulating or recreating a standard card table surface. Cards may be readily viewed by other players at a table, which is standard in table games and adds to player enjoyment. Individual monitors, especially where slanted towards the individual players make such table-wide card reading difficult. The use of the common display also allows for better animation to be provided, such as displaying virtual images of cards moving to the player and "virtual" chips being placed on the table when wagers are indicated. For purposes of this disclosure, the term "virtual" means a graphical video representation of a real object or person, such as a dealer, cards and chips, for example.

The individual player positions preferably have a separate intelligence at each player position that accepts player input and communicates directly with a game engine (main game computer or processor). The intelligence is preferably an intelligent board that can process information. For purposes of this disclosure the term "intelligent" refers to the ability to execute code, either provided in the form of software or hardware or a combination of software and hardware circuits. Such processing may at least comprise some of signal converting (e.g., signals from player card readers, credit deposit, currency readers, coin readers, touch screen signals, ticket readers/printers and control panel signals) into a signal that can be included in an information packet and interpreted by the main game computer when the signal is sent. Communication between the intelligence at each player position is direct to the main game computer and may be by self-initiated signal sending, sequenced polling by the main game computer (e.g., each position communicates directly to the main game computer in turn), timed communication, or any other order of communication that is direct between the intelligence and the main game computer.

One preferred form of communication between the main game computer and player station computers is by means of self-initiated signal sending. There is essentially a single main game computer that contains video display controls and programs for both the dealer display and the table top display, audio controls and programs, game rules (including storage of multiple games if intended to be available on the machine), random number generator, graphic images, game sequence controls, security systems, wager accounting programs, external signaling and audit functions, and the like. In other forms of the invention, the above functions are divided between a main processor and one or more additional processors. The intelligence at each player position speeds up the performance of all aspects of the game by being able to communicate directly with the main game computer and being able to process information at the player position rather than merely forwarding the information in raw form to the main game computer. Processing player information at player positions frees up resources for use by the main processor or processors.

A card game system may also include a suitable data and control processing subsystem that is largely contained within a main control module supported beneath the tabletop. The control and data processing subsystem includes a suitable power supply for converting alternating current from the power main as controlled by a main power switch. The power supply transforms the alternating line current to a suitable voltage and to a direct current supply. Power is supplied to a power distribution and sensor/activity electronics control circuit. Commercially available power switching and control circuits may be provided in the form of a circuit board which is detachable, and plugs into a board receptacle of a computer mother board or an expansion slot board receptacle. A main game controller motherboard may include a central microprocessor and related components well-known in the industry as computers using Intel brand Pentium® microprocessors and related memory or intelligence from any other manufacturing source. A variety of different configurations and types of memory devices can be connected to the motherboard as is well known in the art. Of particular interest is the inclusion of two flat panel video display control boards connected in expansion slots of the motherboard. Display control boards are each capable of controlling the images displayed for the dealer video display and for the common display area. More specifically, the display control boards are connected to player bet interface circuits for the player stations. This arrangement allows the display control boards to provide necessary image display data to the display electronic drive circuits associated with the dealing event program displays and the dealer display.

The motherboard and/or the individual player intelligent boards also include a serial port that allows stored data to be downloaded from the motherboard to a central casino computer or other additional storage device. In one example, each player board communicates directly with the casino computer system. This allows card game action data to be analyzed in various ways using added detail, or by providing integration with data from multiple tables so that cheating schemes can be identified and eliminated, and player tracking can be maintained. Player performance and/or skill can be tracked at one table or as a compilation from gaming at multiple tables, as by using Bloodhound™ security software marketed by Shuffle Master, Inc., which may be incorporated into this automated gaming system. Additionally, player hand analysis can be performed. The motherboard and/or individual player intelligent boards may also have a keyboard connection port that can be used to connect a larger format keyboard to the system to facilitate programming and servicing of the system.

Although the preferred system shown does not require features illustrated for receiving automated player identification information, such features can alternatively be provided. Card or ticket readers such as those used with credit cards, play tracking tickets, player cards or other identification code reading devices can be added in the system to allow or require player identification in connection with play of the card game and associated recording of game action by one of the processors. Such a user identification interface, for example a card reader located at each player station, can be implemented in the form of a variety of magnetic card readers commercially available for reading user-specific identification information. The user-specific information can be provided on specially constructed magnetic cards issued by a casino, or magnetically coded credit cards or debit cards frequently used with national credit organizations such as VISA™, MASTERCARD™, AMERICAN EXPRESS™, casino player card registry, banks and other institutions. The information could also be provided on other writable media, such as an RFID chip or card with writable memory, or bar coding, as just a few examples.

Alternatively, it is possible to use so-called smart cards to provide added processing or data storage functions in addition to mere identification data. For example, the user identification could include coding for available credit amounts purchased from a casino. As further example, the identification card or other user-specific instrument may include specially coded data indicating security information such as would allow accessing or identifying stored security information which must be confirmed by the user after scanning the user identification card through a card reader. Such security information might include such things as file access numbers which allow the central processor to access a stored security clearance code which the user must indicate using input options provided on displays using touch screen displays. A still further possibility is to have participant identification using biometrics, such as a fingerprint image, eye blood vessel image reader, iris reader, or other suitable biological information to confirm identity of the user that can be built into the table. Still further it is possible to provide such participant identification information by having the pit personnel manually code in the information in response to the player indicating his or her code name or real name. Such additional identification could also be used to confirm credit use of a smart card or transponder. All or part of the functions dedicated to a particular player station are controlled by the player station intelligence in one form of the invention. Additionally, each player station intelligence may be in communication with a casino accounting system.

It should also be understood that the player display screens can alternatively be provided with suitable display cowlings or covers that can be used to shield display of card images from viewing by anyone other than the player in games where that is desirable. This shielding can also be effected by having light-orientation elements in the panel, and some of these light-orientation elements are electronically controllable. This type of shielding could also be used in controlling visual access to the main game play screen. In this manner, the processor can allow general viewing of cards in games where that is desirable or tolerated, and then alter the screen where desired. These types of features can be provided by nanometer, micrometer or other small particulate or flake elements within a panel on the viewing area that are reoriented by signals from the processor. Alternatively, liquid crystal or photo chromatic displays can be used to create a screening effect that would allow only viewers at specific angles of view from the screen area to view the images of cards. Such an alternative construction may be desired in systems designed for card games different from blackjack, where some or all of the player or dealer cards are not presented for viewing by other participants or onlookers. Such display covers or cowlings can be in various shapes and configurations as needed to prevent viewing access. It may alternatively be acceptable to use a player-controlled switch that allows the display to be momentarily viewed and then turned off. The display can be shielded using a cover or merely by using the player's hands. Still further it is possible to use a touch screen display that would be controlled by touch to turn on and turn off. Similar shielding can be used to prevent others from viewing the display.

A review of the Figures will assist in a further understanding of the invention.

Figure 1C:
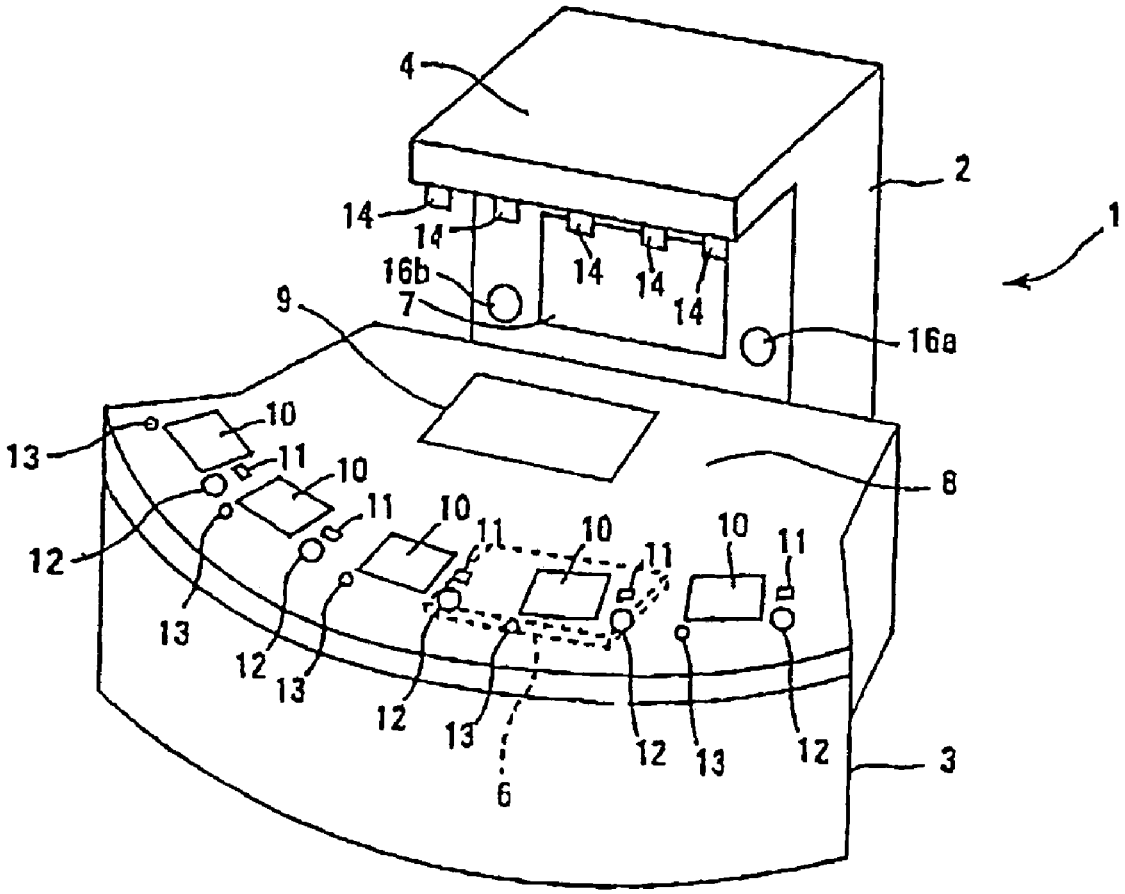
Fig. 1C Prior Art
FIG. 1C shows a perspective view of a prior art format for an automated gaming system.

FIG. 1C shows a fully automated gaming table 1 of the prior art, as disclosed in U.S. Patent Application 2003/0199316. The system 1 comprises a vertical upright display cabinet 2 and a player bank or station cluster arrangement 3. The vertical display cabinet 2 has a viewing screen 7 on which images of the virtual dealer are displayed. The top 8 of the player bank arrangement 3 has individual monitor screens 10 for each player position, as well as tabletop inserted coin acceptors 11, and player controls 12 and 13. There is a separate and larger game play screen 9 on which dealer and player cards are displayed in a format large enough for all players to view. Additionally, wager areas and/or virtual chips representing wagers are also displayed in this area. Speakers 16*a* and 16*b* are provided for sound transmission and decorative lights 14 are provided.

Figure 2:
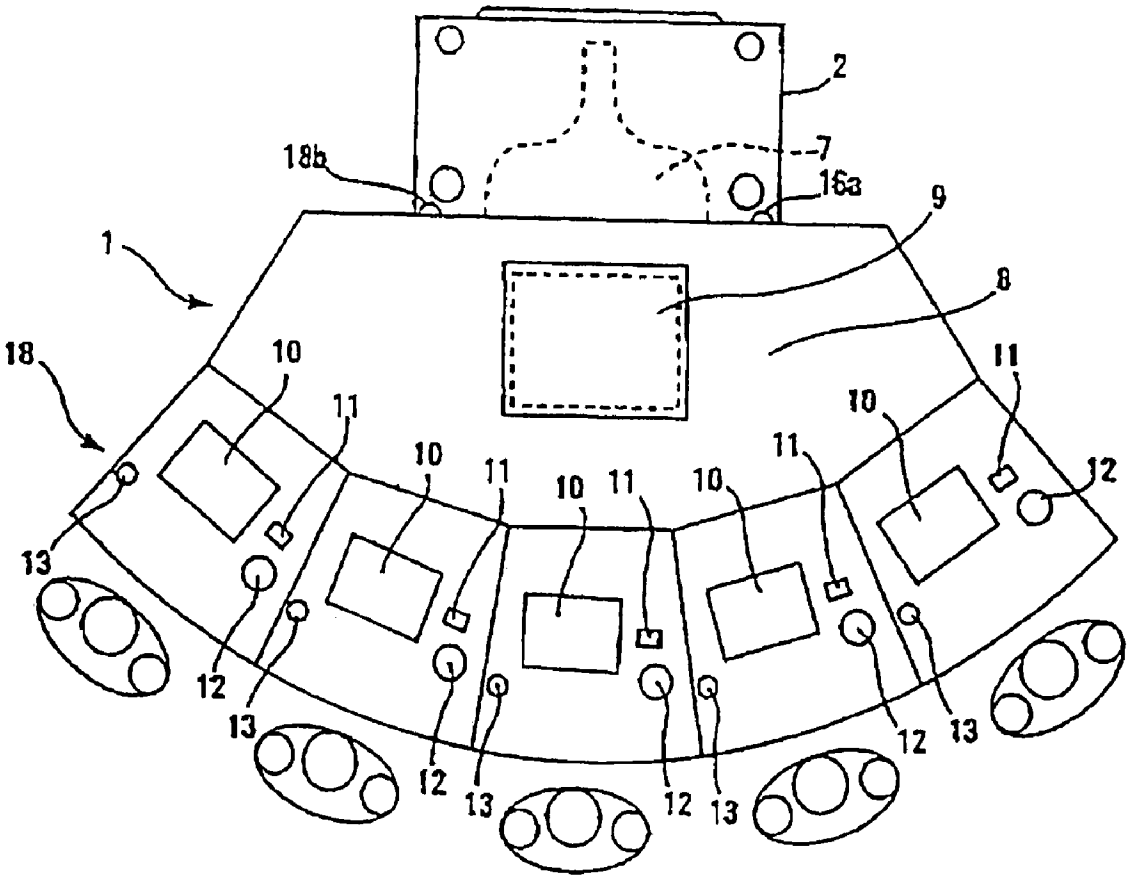
Fig. 2 Prior Art
FIG. 2 shows a top plan view of a prior art format for an automated gaming system.
Figure 3:
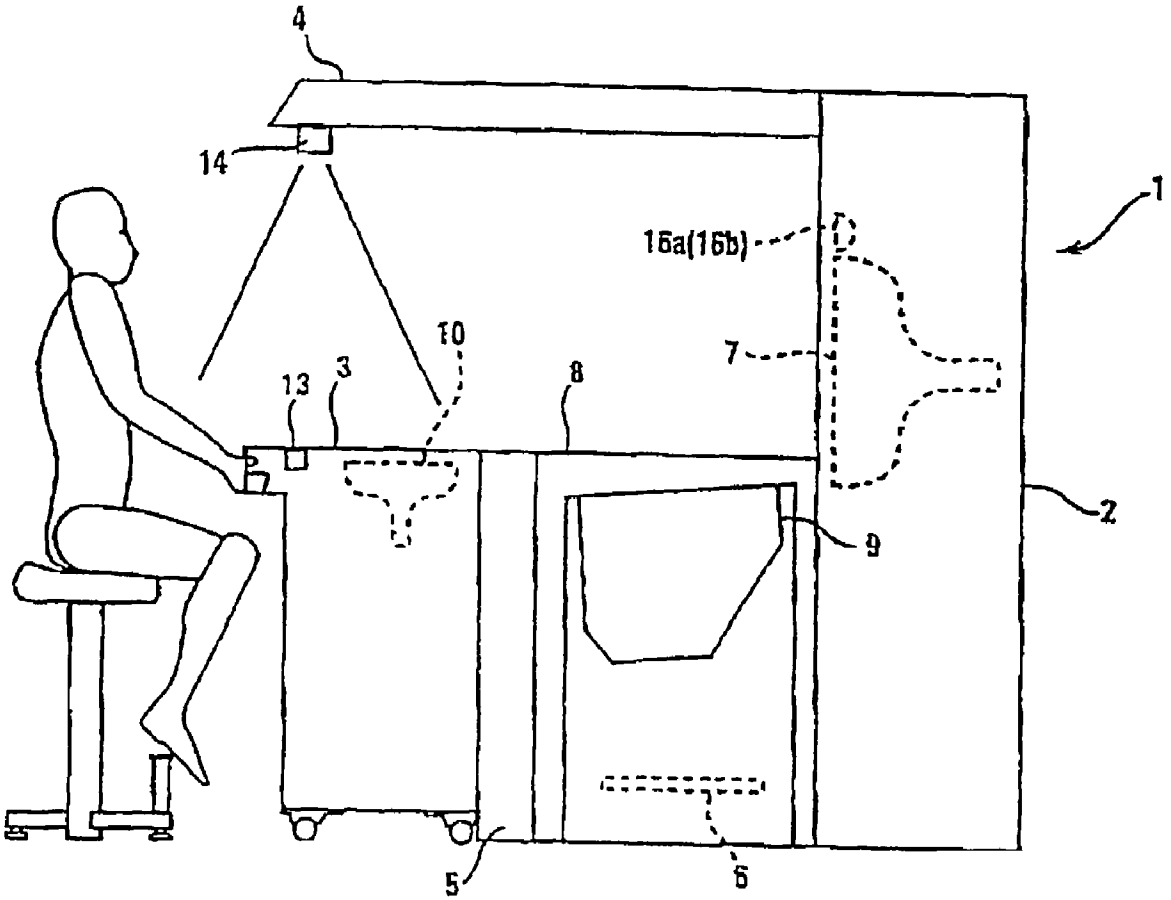
Fig. 3 Prior Art
FIG. 3 shows a side elevational view of a prior art format for an automated gaming system.

FIG. 2 shows a top plan view of the same prior art automated gaming system 1 with the viewing screen 7 shown more clearly as a CRT monitor. It can also be seen that each player position has to form an arc cut into the semicircular player seating area 18. FIG. 3 shows a side elevational view of the same prior art automated gaming system of FIGS. 1C and 2 where the orientation of the three different types of CRT monitors 7, 9 and 10 are shown.

Figure 4:
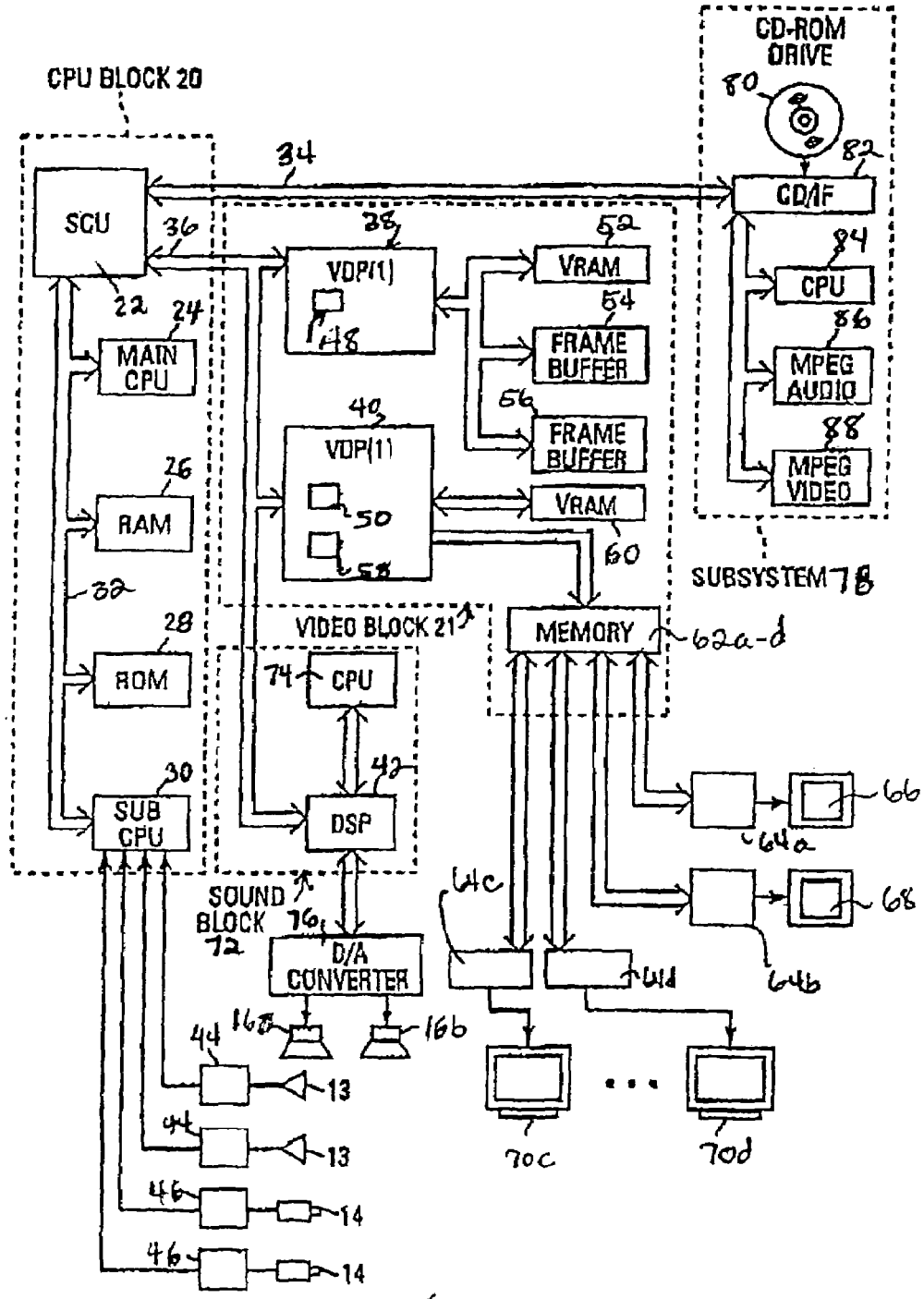
Fig. 4 Prior Art
FIG. 4 shows a block schematic diagram of the electronic configuration of a prior art automated gaming system.

FIG. 4 shows the schematic circuitry of a prior art automated system as disclosed in U.S. Patent Publication No. 2003/0199316. FIG. 4 is a block diagram of processing circuitry in the game device of FIG. 1C. The game device housing comprises a CPU block 20 for controlling the whole device, a picture block 21 for controlling the game screen display, a sound block for producing effect sounds and the like, and a subsystem for reading out CD-ROM.

The CPU block 20 comprises an SCU (System Control Unit) 22, a main CPU 24, RAM 26, RAM 28, a sub-CPU 30, and a CPU bus 32. The main CPU 24 contains a math function similar to a DSP (Digital Signal Processing) so that application software can be executed rapidly.

The RAM 26 is used as the work area for the main CPU 24. The RAM 28 stores the initialization program used for the initialization process. The SCU 22 controls the busses 32, 34 and 36 so that data can be exchanged smoothly among the VDPs 38 and 40, the DSP 42, and other components.

The SCU 22 contains a DMA controller, allowing data (polygon data) for character(s) in the game to be transferred to the VRAM in the video picture block 21. This allows the game machine or other application software to be executed rapidly. The sub-CPU 30 is termed an SMPC (System Manager & Peripheral Control). Its functions include collecting sound recognition signals from the sound recognition circuit 44 or image recognition signals from the image recognition circuit 46 in response to requests from the main CPU 24. On the basis of sound recognition signals or image recognition signals provided by the sub-CPU 30, the main CPU 24 controls changes in the expression of the character(s) appearing on the game screen, or performs image control pertaining to game development, for example. The picture video block 21 comprises a first VPD (Video Display Processor) 38 for rendering TV game polygon data characters and polygon screens overlaid on the background image, and a second VDP 40 for rendering scrolling background screens, performing image synthesis of polygon image data and scrolling image data based on priority (image priority order), performing clipping, and the like. The first VPD 38 houses a system register 48, and is connected to the VRAM (DRAM) 52 and to two frame buffers 54 and 56. Data for rendering the polygons used to represent TV game characters and the like is sent to the first VPD 38 through the main CPU 24, and the rendering data written to the VRAM 52 is rendered in the form of 16- or 8-bit pixels to the rendering frame buffer 54 (or 56). The data in the rendered frame buffer 54 (or 56) is sent to the second VDP 40 during the display mode. In this way, buffers 54 and 56 are used as frame buffers, providing a double buffer design for switching between rendering and display for each individual frame. Regarding information for controlling rendering, the first VPD 38 controls rendering and display in accordance with the instructions established in the system register 48 of the first VPD 38 by the main CPU 24 via the SCU 22.

The second VDP 40 houses a register 50 and color RAM 58, and is connected to the VRAM 60. The second VDP 40 is connected via the bus 36 to the first VPD 38 and the SCU 22 and is connected to picture output terminals Voa through Vog through memories 62*a-d* and encoders 64*a-d*. The picture output terminals Voa through Vog are connected through cables to the main game displays 66, 68 and the satellite displays 70. Scrolling screen data for the second VDP 40 is defined in the VRAM 60 and the color RAM 58 by the CPU 24 through the SCU 22. Information for controlling image display is similarly defined in the second VDP 40. Data defined in the VRAM 60 is read out in accordance with the contents established in the register 50 by the second VDP 40, and serves as image data for the scrolling screens that portray the background for the character(s). Image data for each scrolling screen and image data of texture-mapped polygon data sent from the first VPD 38 is assigned display priority (priority) in accordance with the settings in the register 48, and the final image screen data is synthesized.

Where the display image data is in palette format, the second VDP 40 reads out the color data defined in the color RAM 58 in accordance with the values thereof, and produces the display color data. Color data is produced for each display 66 and 68 and for each satellite display 70. Where display image data is in RGB format, the display image data is used as-is as display color data. The display color data is temporarily stored in memories 62*a-d* and is then output to the encoders 64*a-d*. The encoders 64*a-d* produce picture signals by adding synchronizing signals to the image data, which is then sent via the picture output terminals Voa through Vog to the display 66, 68 and the satellite displays 70. In this way, the images required to conduct an interactive game are displayed on the screens of the display 66, 68 and the satellite displays 70.

The sound block 72 comprises a DSP 42 for performing sound synthesis using PCM format or FM format, and a CPU 74 for controlling the DSP 42. Sound data generated by the DSP 42 is converted into 2-channel sound signals by a D/A converter 76 and is then presented to audio output terminals Ao via an interface (not shown). These audio output terminals Ao are connected to the input terminals of an audio amplification circuit (not shown). Thus, the sound signals presented to the audio output terminals Ao are input to the audio amplification circuit (not shown). Sound signals amplified by the audio amplification circuit drive the speakers 16*a* and 16*b*.

The subsystem 78 comprises a CD-ROM drive 80, a CD-I/F 82, and CPU 84, an MPEG-AUDIO section 86, and an MPEG-PICTURE section 88. The subsystem 78 has the function of reading application software provided in the form of a CD-ROM and reproducing the animation. The CD-ROM drive 80 reads out data from CD-ROM. The CPU 84 controls the CD-ROM drive 80 and performs error correction on the data read out by it. Data read from the CD-ROM is sent via the CD-I/F 82, bus 34, and SCU 22 to the main CPU 24 that uses it as the application software. The MPEG-AUDIO section 86 and the MPEG-VIDEO section 88 are used to expand data that has been compressed in MPEG (Motion Picture Expert Group) format. By using the MPEG-AUDIO section 86 and the MPEG-VIDEO section 88 to expand data that has been compressed in MPEG format, it is possible to reproduce motion picture. It should be noted herein that there are distinct processors for the CPU block, video block, sound block, CD-ROM drive and Memory with their independent CPU's. This requires significant computing power and still has dumb (no intelligence) player input components.

Figure 5:
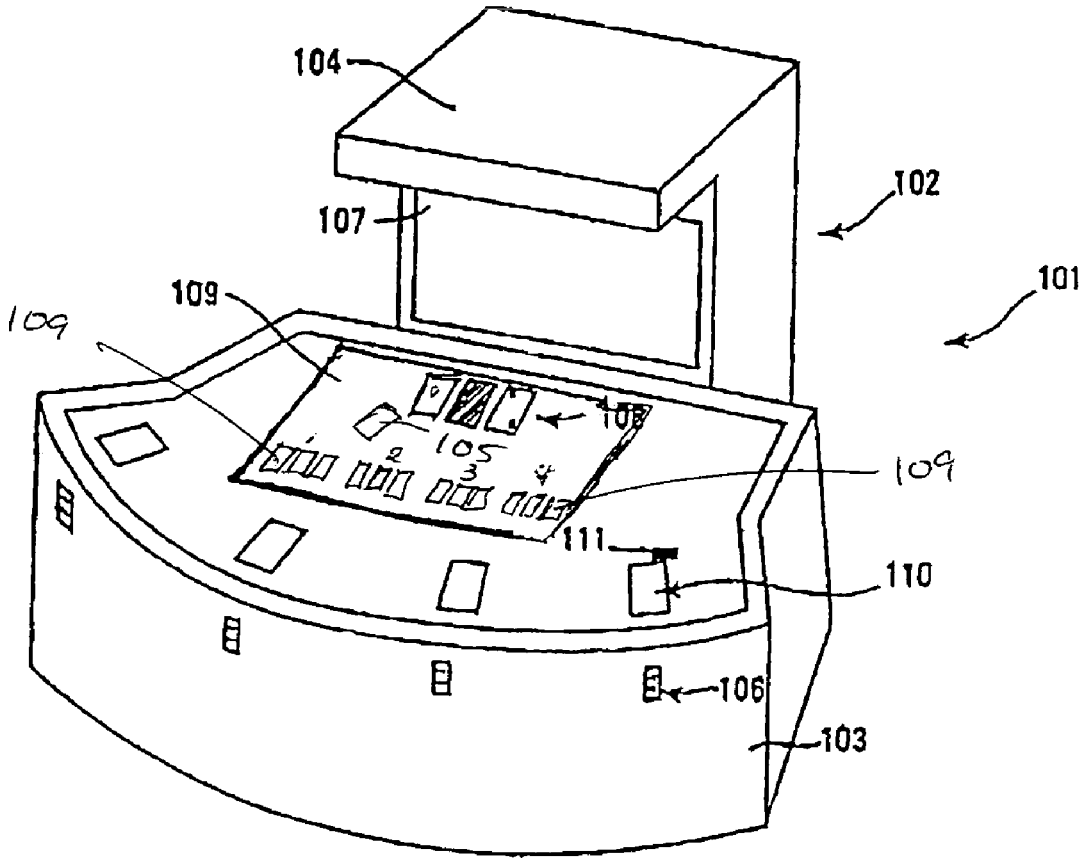
FIG. 5 shows a perspective view of a format for an automated gaming system according to the present invention.

FIG. 5 shows another example of an automated table system 101 useful to practice the game play methods of the present invention. The system 101 has an upright dealer display cabinet 102 with a top 104 and the dealer viewing screen 107 which may be any form of display screen such as a CRT, plasma screen, liquid crystal screen, LED screen or the like. The dealer screen 107 displays a virtual dealer, the dealer responding to instructions from the players. The player bank arrangement 103 has a common display screen 109 on which images of cards being dealt 105, dealer's cards 108, player cards 109, bets wagered (not shown) and also includes touch screen with or without electromechanical player input functions. The display 110 at each player station can also display information such as the composition of the player's hand, the credits wagered, historical win/loss information, pay tables and the like. Other player input functions may be provided on a panel 106 which might accept currency, coins, tokens, identification cards, player tracking cards, ticket in/ticket out acceptance, and the like.

Figure 6:
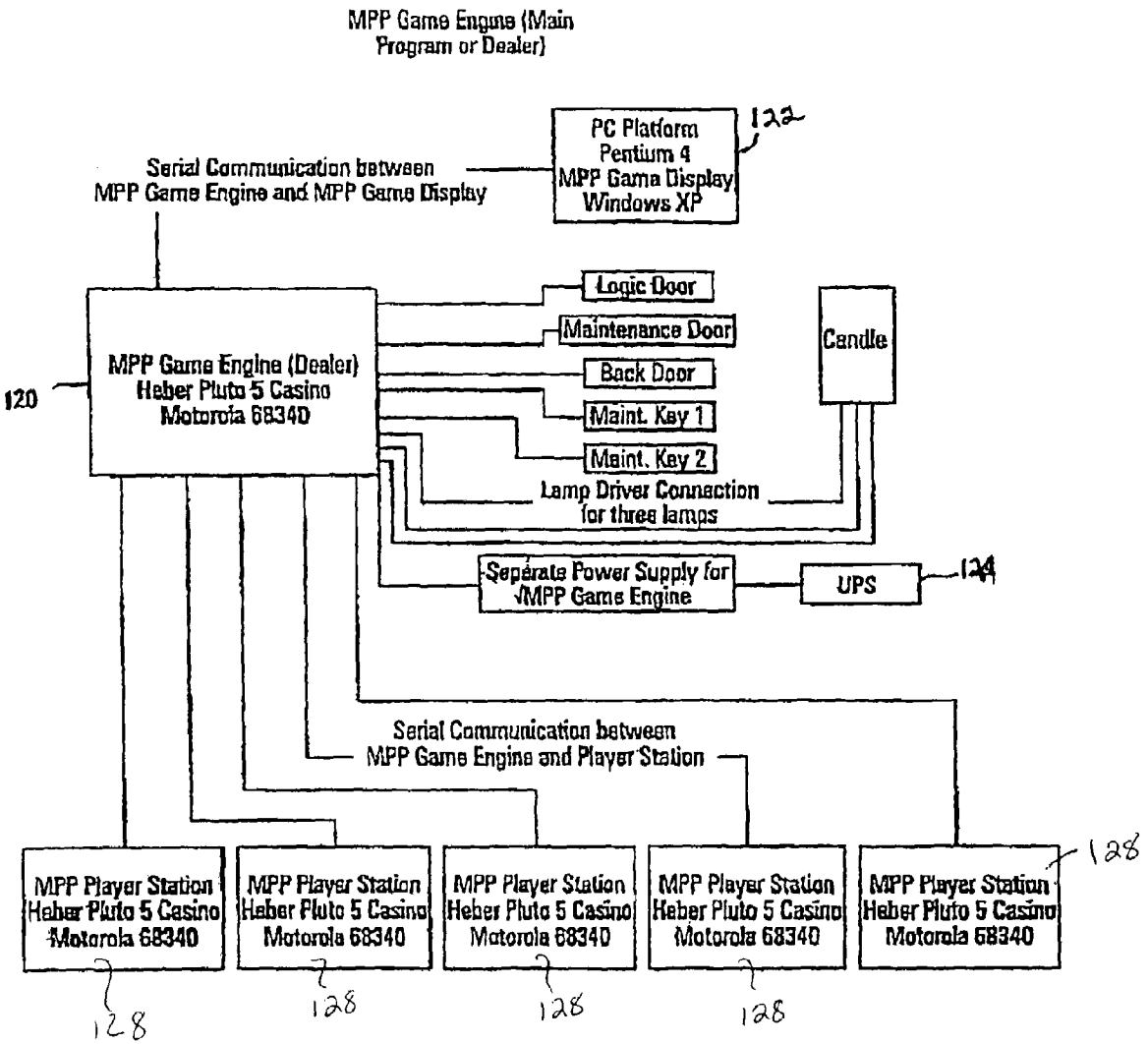
FIG. 6 shows a schematic diagram of a gaming engine useful in the practice of the present invention.

FIG. 6 shows an electronic/processor schematic for a MultiPlayer Platform (MPP) gaming system according to the presently described invention. The MPP Game engine (dealer) comprises a Heber Pluto 5 casino game board 120 (Motorola 68340 board) operating off the PC Platform Pentium®4 MPP Game Display processor 122. The game display processor operates on a Windows XP platform. The respective subcomponents on the Pentium 4 processor are labeled to show the apportionment of activity on the motherboard and the component parts added to the board. As is shown, the game engine has an Uninterruptible Power Supply 124. The game display processor directs activity on the Speakers, directs activities onto the MPP Game Service panel, and the Plasma Monitor Card Table display. It is important to note that all communications are direct from the game display processor, freeing up resources available to the game engine processor.

Figure 7:
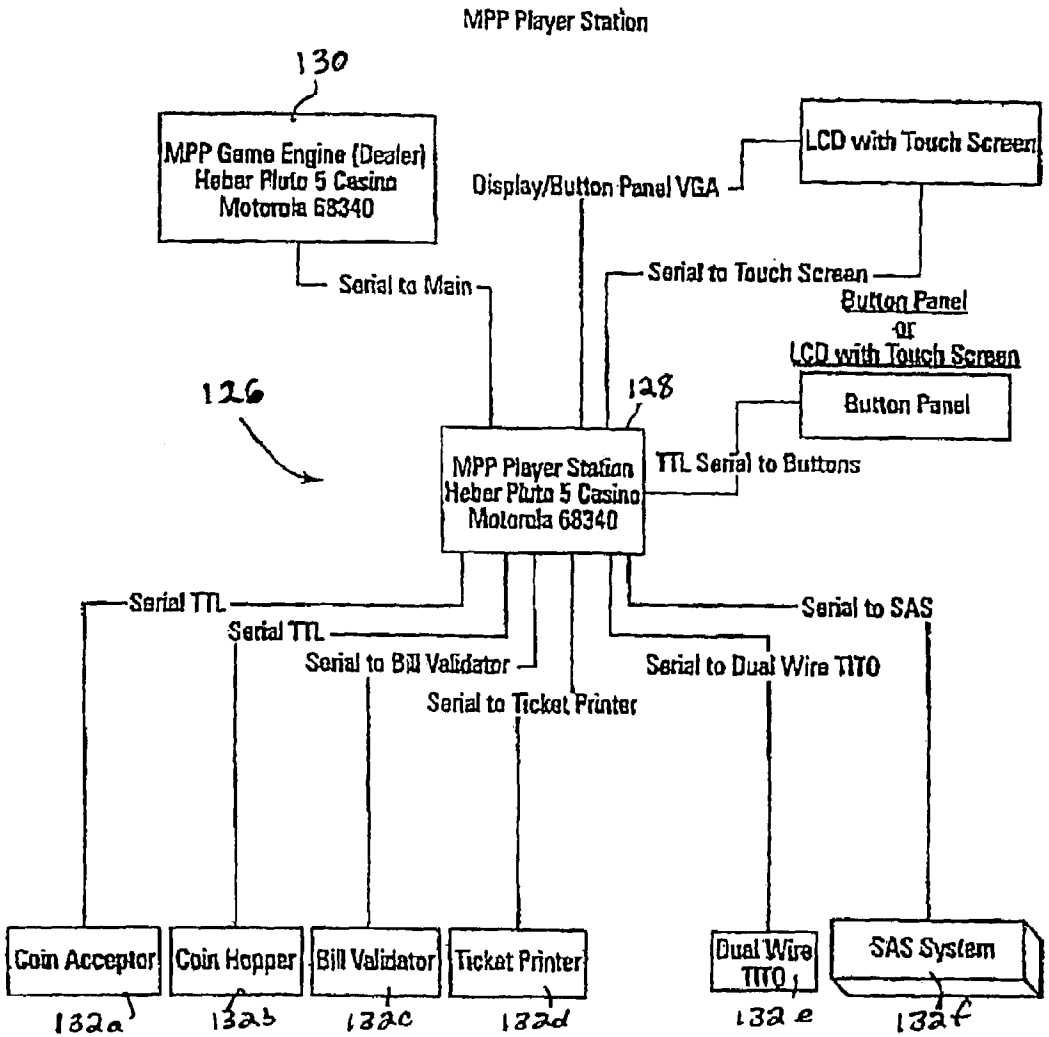
FIG. 7 shows a schematic diagram of a player station useful in the practice of the present invention.

FIG. 7 shows the electronic/processing schematics 126 of the MPP Player Station Intelligence board 128 (Heber Pluto 5 Casino, Motorola 68340), each of which player stations (one for each player position) is in direct connection to the MPP Game Engine 130 (Dealer), which is in turn directly connected to the PC Platform (not shown in this Figure). Each Intelligence board receives information for all player input systems 132*a-f* specific to that player station, such as the shown Coin Acceptor, Coin Hopper, Bill validator, Ticket Printer, Touch Screen and/or Display Button Panel, Dual Wire Ticket-in-Ticket-Out Printing and SAS System (SAS is one exemplary standard communications protocol used by a number of casinos central computer systems.) A significant benefit resides in the use of the independent Intelligent boards 128 at each player position being in direct communication with the MPP Game Engine 130, as opposed to each individual player position button panel being dead or inactive until authorized by the main game processor, as previous automated gaming systems were constructed.

The above-described architecture is also an improvement in providing a system with not only the intelligence at each player position, but also in redistributing processing capability for functions among various processing components within the gaming system. In one architectural format, all functions of the gaming engine, except for the player localized intelligence functions, are consolidated into a single PC (e.g., the Pentium 4 shown in the Figures). This would include all game functions, player video functions, dealer video functions, dealer audio functions, security, central reporting (to a casino's central computer, for example), currency and debit functions, alarm functions, lighting functions, and all other peripherals on the system, except for the localized player functions. Alternatively, all functions requiring communication with the casino's main computer system are located on the player station intelligent boards. In this system, the main game processor would talk directly with the player intelligent boards, preferably in the same novel communication format described below.

Figure 8:
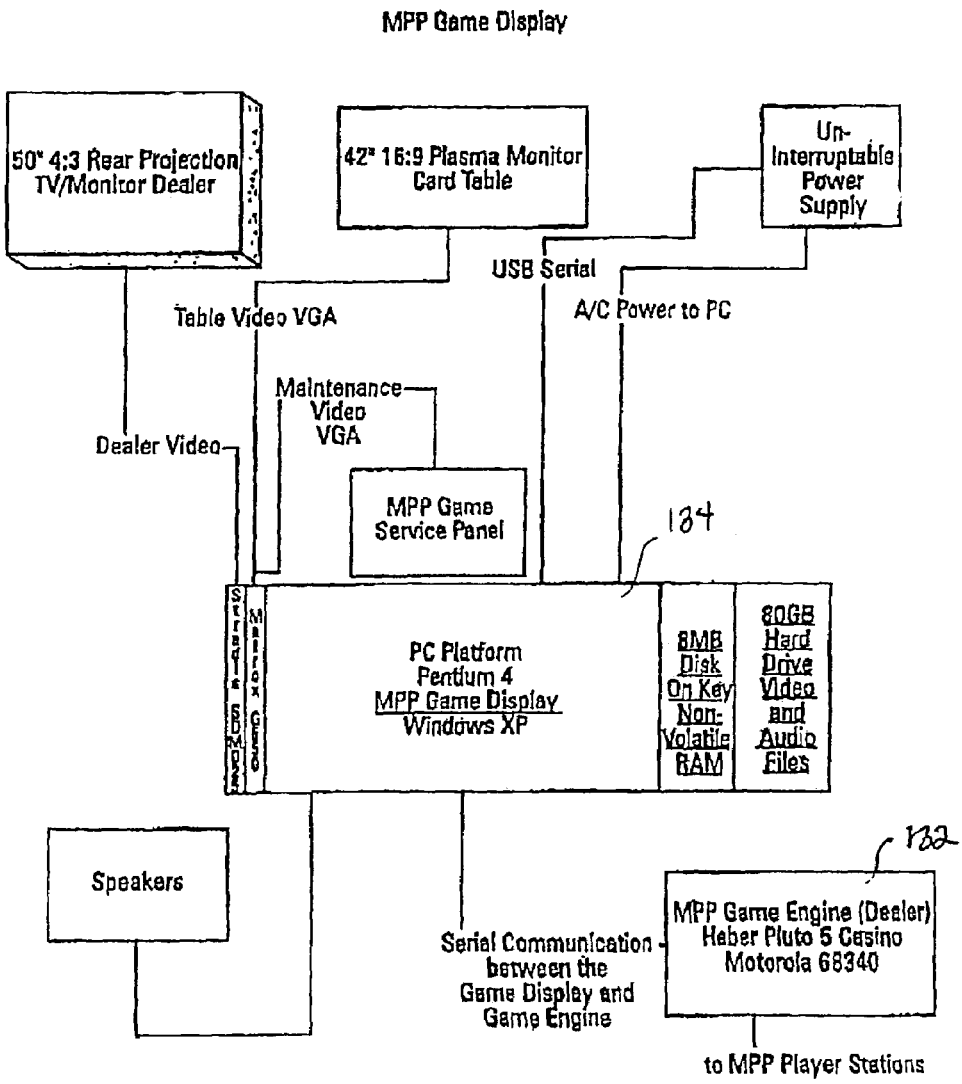
FIG. 8 shows a schematic diagram of a game display useful in the practice of the present invention.

An alternative system is shown in FIG. 8, where there is a dealer engine processor 132 intermediate the main game PC 134 and the Player intelligent boards (not shown). Both systems are a distinct improvement over the prior art, but with the higher power available for PC's, and with the ease of programming a PC as opposed to an embedded system, the consolidation of the game functions and the ability of the main game engine to communicate with each of the player positions is enabled. As shown in FIG. 8, the Game display processor 134 is preferably a Pentium® 4 PC and is separate from the main processor 132. With the player intelligent boards, the main game PC can receive packets of information from each player station as events occur rather than having to poll each player position on a regular basis 100 times to gain the specific information for each player input that may be made.

A description of the Heber Board, (an exemplary board that can be used as a player station processor and/or game engine processor 132) a commercially available intelligent processing board is as follows. The Heber Board is known for its reliability and flexibility, especially for the Pluto 5 family of gaming products. The Pluto 5 is the controller of choice for the global gaming industry. Flexibility comes from a set of features built into the Pluto 5 (Casino) controller, and from the choice of optional add-on boards that can be used to adapt the Pluto family to best suit individual applications. In the area of interfacing, there are three distinct boards, each of which serves a particular function in helping the Pluto 5 to connect with the world outside.

RS485 Board

RS485 is an industrial-grade board for linking multiple systems in unforgiving circumstances for centralized information gathering. The Heber RS485 board is fully optically-isolated to provide complete circuit safety when used within 'electrically noisy' environments. The RS485 board uses a single RS232 connection to the Pluto 5 board and all necessary power is also derived through this link. Two header connectors may be provided for the RS485 channel to allow daisy chain connections between multiple systems.

HII/ccTalk Board

This board specializes in communicating with industry standard note/coin acceptors and payout hoppers. Equipped with dual communication channels, each port is configurable to use either the HII format to connect with Mars® coin/note acceptors or the ccTalk format for Money Controls® hoppers. Both channels are controlled via a single RS232 connection to the Pluto 5 board and all necessary power is also derived through this link. The Heber FastTrack™ package contains modular library functions for passing information via these channels.

Four Channel Relay Board

The relay board allows control of medium- to high-level loads such as solenoids, without risk of damage or interference to the Pluto 5 circuitry. Four power-switching channels are available with absolute isolation from the Pluto 5 control signals. Each relay is capable of switching direct or alternating currents of up to 7 A at a maximum voltage of 250V.

Like the Pluto 5 board itself, its modular options have been used extensively so that their designs are fully developed and entirely stable. The options that are specified are consistently provided in mass quantities. As with all Pluto products, programming for the modular options is straightforward. This is enhanced with the use of the Pluto 5 Enhanced Development Kit and also the FastTrack™ package. Between them, these kits contain all of the low level and high level programming tools and library functions needed for gaming applications. These systems can be provided through a Pluto 5 Enhanced Development Kit datasheet 80-15353-7 (Heber Limited, Belvedere Mill, Chalford, Stroud, Gloucestershire, GL6 8NT, UK Tel: +44 (0) 1453 886000 Fax: +44 (0) 1453 885013; www.heber.co.uk). Specifications for the various boards are identified below.

RS485 Interface

Host Interface
- RS232 connection to Pluto 5/Pluto 5 Casino
- All power provided via RS232 link from host system Communication Port
- Dual four-way Molex 0.1" KK headers for daisy chaining purposes Dimensions
- 80×61 mm (3.14×2.4")

Part Number
- Opto-isolated RS485 board 01-14536-2

HII/ccTalk Interface

Host Interface
- RS232 connection to Pluto 5/Pluto 5 Casino
- All power provided via RS232 link from host system Communication Port
- Single or dual 10 way header connectors Dimensions
- 101.6×69.85 mm (4×2.8")

Part Number
- Dual channel HII/ccTalk board 01-16171-2

Four Channel Relay Board

Host Interface
- Connection to Pluto 5/Pluto 5 Casino via ribbon cable using four standard output lines
- All power provided via ribbon cable link from host system Switching Capabilities
- Up to 250V AC or DC@7 A maximum per channel Dimensions
80×61 mm (3.14×2.4")

Part Number
Four channel relay board
01-15275-1
80-16949-1

One proposed hardware configuration uses a "satellite" intelligent processor at each player position. The player station satellite processor is substantially the same as the primary game engine processor, a Heber Pluto 5 Casino board. The satellite processors receive instruction from the primary game engine but then handle the communications with player station peripherals independently. Each satellite processor communicates with only the peripherals at the same player station. Thus each player station has a dedicated satellite processor communicating with only the peripherals at the same player station and with the casino's central computer system. The peripherals are, but not limited to: Slot accounting Systems, Bill Validator, Ticket Printer, Coin Acceptor, Coin Hopper, Meters, Button panel or LCD touch screen and various doors and keys.

The satellite processors run proprietary software to enable functionality. The player station software is comprised of two modules, the first being an OS similar to the game engine Operating System and the second being station software that handles peripheral communications. The software may be installed on EPROMs for each satellite processor. The primary method of communication between the satellite processors and the primary game engine is via serial connectivity and the previously described protocol. In one example, information packets are prepared by the satellite processors and are sent to the game engine processor on the happening of an event.

The proposed game engine provides communication to the player stations to set the game state, activate buttons and receive button and meter information for each player station. Communication is via a serial connection to each of the stations. The new protocol for communication between the game engine, game display and player stations is an event driven packet-for-packet bi-directional protocol with Cyclic Redundancy Check (CRC) verification. This is distinguished from the Sega system that used continuous polling. This communication method frees up resources in the same engine processor because the processor no longer needs to poll the satellites continuously or periodically.

The new protocol uses embedded acknowledgement and sequence checking. The packet-for-packet protocol uses a Command Packet, Response Packet and a Synchronization Packet as illustrated below. The protocol uses standard ASCII characters to send data and a proprietary verification method.

Format of Command Packet

| STX | SEQ | DATA LENGTH | DATA | CRC-16 | ETX |
|---|---|---|---|---|---|
| 1 | 1 | 3 | 3-999 | 5 | 1 |

Format of Response Packet

| STX | SEQ | DSP | PRV | ETX |
|---|---|---|---|---|
| 1 | 1 | 1 | 1 | 1 |

Format of Synchronization Response Packet

| STX | MTS | MRS | ETX |
|---|---|---|---|
| 1 | 1 | 1 | 1 |

Legend for Figures

| | |
|---|---|
| STX | Start of Packet Character |
| SEQ | Sequence # (Cycles from '0' thru '9') |
| LEN | Length of Data Area ('003' thru '999') |
| DATA | ASCII Data Fields Separated with '\|' Character |
| CRC | CRC-16 Value ('0000' thru '65535') Cyclic Redundancy Check |
| ETX | End of Packet Character |
| DSP | Disposition Code ('A' ACK, 'N' NAK, or 'I' Invalid Sequence) |
| PRV | Sequence Number of Last ACK'ed Packet (0 thru 9) |
| MTS | Main's Current Transmit Sequence Number |
| MRS | Main's Current Receive Sequence Number |

The Command Packet and Response Packet are used during primary game communications. The protocol uses redundant acknowledgement. For example: The packet is initially acknowledged when first received by the recipient. The same recipient will resend another acknowledgement in the next communication. This second acknowledgement is the 'PRV' data in the response packet.

The communications between the Game Engine and the Player Station intelligence is preferably a transaction-based protocol. Either device can start a transaction, which is why it is essential that there be an intelligent board at each player position. All packets of information may be sent in any acceptable format, with ASCII format preferred as a matter of designer choice. All command packets usually contain a sequence number that is incremented after each successful packet exchange. The Game Engine and the Player Station intelligence use sequence numbers that are independent of each other. The sequence number keeps the communications in synchronization. This synchronization method is described later.

The command packet is used to send various commands such as Inputs, Lamps, Doors, Errors, Chirp, Game Results, player input, coin acceptance, player identification, credit acceptance, wagers, etc . . . The command packet format may be, by way of a non-limiting example:

<STX><Sequence number><Data Length><Data><CRC-16><ETX>

The data format with in the command packet may or must be:

<Address><Command><Field 1>|<Field 2>|<Field n>|

The response packet format may or must be:

<STX><Sequence number><Disposition><Previous ACK><ETX>

The sync request packet format may or must be:

<SYN>

The sync response packet format may or must be:

<STX><Mains Current Transmission Sequence><Mains Current Receive Sequence><ETX>

A major strength of the protocol is its resilience of the Game Protocol and its ability to free up resources within the game engine. Those resources can in turn be used to provide more intricate games, and multi-media affects.

Synchronization Method:

The satellite and host must become synchronized in order to provide for reliable communications using packet numbers. To facilitate this, a novel protocol synchronization method that is used. Upon applying power to the satellite, or after a communications failure, the satellite automatically enters into synchronization mode. In the synchronization mode the satellite sends out the ASCII SYN (0×16) character about every second. It is expecting a special response packet containing transmit and receive packet sequence numbers to be used from that point on. After receiving the special response packet, the sequence numbers are used as-is, and not incremented until a successful packet exchange is completed. After communications is synchronized, the sequence numbers are incremented after each packet is successfully sent or received.

As was noted before, the main game processor may contain information, data, programming and other necessary functions to enable the play of multiple games off the same machine. For example, the main game engine may have rules and commands that will enable play of the games of the present invention and other card games. The system may be controlled so that different games may be played at different times on command of the casino or players.

All of the apparatus, devices and methods disclosed and claimed herein can be made and executed without undue experimentation in light of the present disclosure. While the apparatus, devices and methods of this invention have been described in terms of both generic descriptions and preferred embodiments, it will be apparent to those skilled in the art that variations may be applied to the apparatus, devices and methods described herein without departing from the concept and scope of the invention. More specifically, it will be apparent that certain elements, components, steps, and sequences that are functionally related to the preferred embodiments may be substituted for the elements, components, steps, and sequences described and/or claimed herein while the same of similar results would be achieved. All such similar substitutions and modifications apparent to those skilled in the art are deemed to be within the scope and concept of the invention as defined by the appended claims.

What is claimed is:

1. A method of conducting a wagering game based upon three-card poker rank utilizing one or more decks of standard playing cards comprising the steps of:

providing a physical deck of playing cards;

receiving an ante wager from a player;

receiving a blind wager from the player;

dealing a first number cards to each player to form at least one player hand;

dealing a second number of cards to a dealer to form a dealer's hand;

receiving a play wager from the player, the play wager being a multiple of the ante wager, the multiple being at least 1 and being selectable by the player;

comparing the three-card poker rank of the player's hand with the three-card poker rank of dealer's hand to resolve the ante and play wagers, wherein the player wins the ante and play wagers if the poker rank of the player's hand outranks the poker rank of the dealer's hand; and comparing the player's hand with a predetermined winning criteria to resolve the blind wager, wherein the player wins the blind wager if the player's hand satisfies the predetermined winning criteria and the three-card poker rank of the player's hand outranks the three-card poker rank of the dealer's hand, the blind wager pushes if the poker rank of the player's hand outranks the three card poker rank of the dealer's hand but the player's hand does not satisfy the predetermined winning criteria, and the blind wager loses if the player's hand has a lower poker rank than the dealer's hand and the player hand does not satisfy the predetermined winning criteria.

2. The method according to claim 1, wherein the final number of cards in the player and dealer hands is equal to three.

3. The method according to claim 1, wherein the final number of cards in the player and dealer hands is equal to four.

4. The method according to claim 3, wherein an initial number of cards in the player and dealer hands is at least five.

5. The method according to claim 1, wherein after the player views his cards, the player must make an additional Play wager that is a multiple of the Ante wager to stay in the game, wherein the multiple is selectable by the player.

6. The method according to claim 5, wherein the Ante wager and Blind wager are forfeited if the play wager is not received from the player.

7. The method according to claim 5, wherein the play wager is a multiple of the ante wager selected by the player when a three card poker rank of the player's hand outranks a qualifying hand rank, wherein the multiple is greater than 1 and the qualifying hand rank is one pair or greater.

8. The method according to claim 1, wherein receiving the ante wager and receiving the blind wager are required to permit the player to play the game.

9. The method according to claim 8, wherein the ante and blind wagers must be wagers of an equal amount.

10. The method according to claim 1, further comprising the steps of:

receiving a Bonus wager from the player; and providing a Bonus payout to the player if the poker rank of the player's hand is equal to or outranks one Pair.

11. The method according to claim 10, wherein the Bonus wager is resolved prior to the step of receiving a play wager from the player and the Bonus payout is provided to the player regardless of whether the Play wager is received from the player.

12. The method according to claim 10, wherein the Bonus payout increases depending on the rank of the player's poker hand rank.

13. The method according to claim 12, further comprising the Bonus payout amount is a whole number multiple of the Bonus wager.

14. The method according to claim 1, wherein the hands are ranked according to a scale, wherein A=Ace, K=King, Q=Queen, J=Jack and numbers 10 to 2 designate the other cards:

| | | |
|---|---|---|
| Highest: | Straight Flush: | Three of one suit in sequence<br>AKQ highest<br>KQJ next highest<br>QJ10 next highest,<br>and so on, until<br>32A lowest |
| | Three of a Kind: | Three of one rank<br>AAA highest<br>KKK next highest, |

-continued

| | | |
|---|---|---|
| | | and so on, until<br>222 lowest |
| | Straight: | Three of mixed suits in sequence<br>AKQ highest<br>KQJ next highest,<br>and so on, until<br>32A lowest |
| | Flush: | Three of one suit<br>AKJ highest<br>AK10 next highest,<br>and so on, until<br>532 lowest |
| | Pair: | Two of same rank<br>AAK highest<br>AAQ next highest,<br>and so on, until<br>223 lowest |
| Lowest: | High card: | A hand comprising none of the above<br>AKJ highest<br>AK10 next highest,<br>and so on. |

15. The method according to claim 1, further comprising the steps of:

revealing the dealer's hand to the player upon the play wager being received from the player; and comparing the poker rank of the dealer's hand with a predetermined qualifying rank, wherein the ante wager is returned to the player if the predetermined qualifying rank outranks the poker rank of the dealer's hand and the player wins the play wager if both the predetermined qualifying rank and poker rank of the player's hand outrank the poker rank of the dealer's hand.

16. A method of conducting a wagering game based on poker utilizing one or more decks of standard playing cards comprising the steps of:

providing a physical deck of playing cards;

receiving an Ante wager from a player to participate in a round of a game;

receiving a Blind wager from the player;

dealing a plurality of cards to the player to form a player's hand, wherein the player is permitted to view the player's hand;

dealing a plurality of cards to a dealer to form a dealer's hand, wherein the dealer's hand is not displayed to the player;

receiving a play wager from the player, wherein the player forfeits the Ante and Blind wagers and does not continue in the round if the play wager is not received;

revealing the dealer's hand to the player;

comparing a three-card poker rank of the player's hand with the three-card poker rank of dealer's hand to resolve the ante and play wagers, wherein the player wins the Ante and Play wagers if the poker rank of the player's hand outranks the poker rank of the dealer's hand; and comparing the player's hand with predetermined winning criteria to resolve the blind wager, wherein the player wins the blind wager if the player's hand satisfies the predetermined winning criteria and the poker rank of the player's hand outranks the three card poker rank of the dealer's hand, the blind wager pushes if the three-card poker rank of the player's hand outranks the three-card poker rank of the dealer's hand but the player's hand does not satisfy the predetermined winning criteria and the blind bet loses when the dealer's hand outranks the player's three-card poker hand and the player's hand does not satisfy the predetermined winning criteria.

17. The method according to claim 16, wherein the player and dealer hands are three card hands, and the predetermined winning criteria are three card poker hand rankings.

18. The method according to claim 17, further comprising the step of awarding a payout to a player winning the blind wager, wherein the payout is a preset multiple of the blind wager.

19. The method according to claim 16, further comprising the step of:

comparing the three card poker rank of the dealer's hand with a predetermined qualifying rank, wherein the Ante wager is returned to the player if the predetermined qualifying rank outranks the three card poker rank of the dealer's hand and the player wins the Play wager if the predetermined qualifying rank and the three card poker rank of the player's hand outranks the three card poker rank of the dealer's hand.

20. A computer program embedded in a computer executing medium, which program when executed, enables the computer to perform a method of playing a poker wagering game that uses an established set of rules to determine winning or losing outcomes, the program performing steps comprising:

a) the computer containing a database for storing game data relating to rules of a poker-type game, and a predetermined blind wager winning criteria and a pay table relating thereto;

b) the computer containing a processor for:

i) receiving an ante wager from a player;

ii) receiving a blind wager from the player;

iii) dealing at least three cards to the player to form a player's hand;

iv) dealing at least three cards to a dealer to form a dealer's hand;

v) receiving a play wager from the player, the play wager being a player selectable multiple of the ante wager;

vi) comparing the three card poker rank of the player's hand with the three card poker rank of dealer's hand to resolve the ante and play wagers, wherein the player wins the Ante and Play wagers if the player's hand outranks the dealer's hand;

vii) comparing the player's hand with the predetermined blind wager winning criteria to resolve the blind wager, wherein the player wins the blind wager if the player's hand satisfies the predetermined blind wager winning criteria and outranks the dealer's hand, the blind wager pushes when the player's hand outranks the dealer's hand but does not satisfy the predetermined winning criteria, and the blind wager loses when the player's hand does not beat the dealer's hand and does not satisfy the predetermined winning criteria and c) a user interface configured for facilitating player wagers and communicating game activity.

21. A method of playing a wagering game, comprising:

providing a physical deck of playing cards;

placing an Ante wager to participate in a game of chance against a dealer; wherein the game of chance is a card game based on three-card poker rankings;

placing a blind wager on the occurrence of the player hand outranking the dealer hand and the player hand being at least one predetermined winning combination, the blind wager pushing when the player hand outranks the dealer hand in three-card poker rank but the player hand is not a predetermined winning combination;

dealing physical cards to each player to form at least one player hand;

dealing physical cards to a dealer to form a dealer's hand;

receiving a play wager from the player, the play wager being a multiple of the ante wager, the multiple being at least 1 and being selectable by the player;

comparing the three-card poker rank of the player's hand with the three-card poker rank of the dealer's hand to resolve the ante and play wagers, wherein the player wins the ante and play wagers if the poker rank of the player's hand outranks the poker rank of the dealer's hand; and comparing the player's hand with a predetermined winning criteria to resolve the blind wager, wherein the player wins the blind wager if the player's hand satisfies the predetermined winning criteria and the three-card poker rank of the player's hand outranks the three-card poker rank of the dealer's hand, the blind wager pushes if the poker rank of the player's hand outranks the three card poker rank of the dealer's and but the player's hand does not satisfy the predetermined winning criteria, and the blind wager loses if the player's hand has a lower poker rank than the dealer's hand and the player hand does not satisfy the predetermined winning criteria.

* * * * *